US009349326B2

(12) United States Patent
Tada

(10) Patent No.: US 9,349,326 B2
(45) Date of Patent: May 24, 2016

(54) IMAGE DISPLAY APPARATUS AND CONTROL METHOD THEREFOR

(71) Applicant: CANON KABUSHIKI KAISHA, Tokyo (JP)

(72) Inventor: Mitsuru Tada, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 302 days.

(21) Appl. No.: 13/792,631

(22) Filed: Mar. 11, 2013

(65) Prior Publication Data

US 2013/0257918 A1 Oct. 3, 2013

(30) Foreign Application Priority Data

Mar. 30, 2012 (JP) ..... 2012-080930

(51) Int. Cl.
*G09G 3/16* (2006.01)
*G09G 3/34* (2006.01)

(52) U.S. Cl.
CPC ..... *G09G 3/3406* (2013.01); *G09G 2310/0237* (2013.01); *G09G 2310/08* (2013.01); *G09G 2320/0247* (2013.01); *G09G 2320/0261* (2013.01); *G09G 2320/064* (2013.01); *G09G 2320/0646* (2013.01); *G09G 2320/106* (2013.01); *G09G 2360/16* (2013.01)

(58) Field of Classification Search
CPC ..... G09G 2300/0809; G09G 3/2022; G09G 2320/0646; G09G 3/204; G09G 2310/0237; G09G 3/3406
See application file for complete search history.

(56) References Cited

U.S. PATENT DOCUMENTS

2002/0036625 A1* 3/2002 Nakamura ..... G09G 3/3618 345/204
2004/0150586 A1* 8/2004 Urakami et al. ..... 345/60
2005/0007306 A1 1/2005 Ilsaka et al.

(Continued)

FOREIGN PATENT DOCUMENTS

CN 101216624 A 7/2008
JP 2000-322029 11/2000

(Continued)

OTHER PUBLICATIONS

The above patent documents were cited in a European Search Report issued on Aug. 1, 2014, which is enclosed, that issued in the corresponding European Patent Application No. 13160106.4.

(Continued)

*Primary Examiner* — Aneeta Yodichkas
*Assistant Examiner* — Gerald Oliver
(74) *Attorney, Agent, or Firm* — Cowan, Liebowitz & Latman, P.C.

(57) ABSTRACT

An image display apparatus according this invention includes: a light-emitting unit configured to emit light; a display panel configured to display an image by transmitting the light from the light-emitting unit at a transmittance based on an input image signal; and a control unit configured to set a plurality of lighting periods respectively having different lengths on a frame-by-frame basis and control lighting and extinction of the light-emitting unit in such a manner that the light-emitting unit is lit during the lighting periods and extinguished during a period other than the lighting periods, wherein the control unit makes the number of lighting periods within one frame larger when a brightness of the image is bright than when the brightness of the image is dark.

53 Claims, 16 Drawing Sheets

(56) References Cited

U.S. PATENT DOCUMENTS

| | | | | |
|---|---|---|---|---|
| 2005/0248553 | A1* | 11/2005 | Feng et al. | 345/204 |
| 2007/0126757 | A1 | 6/2007 | Itoh et al. | |
| 2008/0150880 | A1* | 6/2008 | Inuzuka et al. | 345/102 |
| 2010/0128225 | A1* | 5/2010 | Nishino et al. | 353/31 |
| 2010/0156964 | A1* | 6/2010 | Masuda et al. | 345/691 |
| 2012/0068993 | A1* | 3/2012 | Kambhatla | G09G 5/399 345/213 |
| 2014/0146027 | A1* | 5/2014 | Tsuge | 345/208 |

FOREIGN PATENT DOCUMENTS

| | | | |
|---|---|---|---|
| JP | 2001-175216 | A | 6/2001 |
| JP | 2001-236034 | A | 8/2001 |
| JP | 2006-018200 | | 1/2006 |
| JP | 2007-256678 | A | 10/2007 |
| JP | 2007-286501 | A | 11/2007 |
| JP | 2008-065228 | | 3/2008 |
| JP | 2009-192753 | A | 8/2009 |
| JP | 2009-251069 | A | 10/2009 |
| JP | 2010-217858 | A | 9/2010 |
| WO | 2010/103424 | A1 | 9/2010 |
| WO | 2011/039995 | A1 | 4/2011 |
| WO | 2011/149094 | A1 | 12/2011 |

OTHER PUBLICATIONS

The above patent documents were cited in a Dec. 3, 2014 Chinese Office Action, which is enclosed with an English Translation, that issued in Chinese Patent Application No. 201310110367.4.

The above patent documents were cited in a Apr. 28, 2015 Japanese Office Action, which is enclosed without an English Translation, that issued in Japanese Patent Application No. 2012-080930.

The above references were cited in a Aug. 18, 2015 Japanese Office Action, which is enclosed without an English Translation that issued in Japanese Patent Application No. 2012-080930.

* cited by examiner

| NUMBER n OF TIMES OF LIGHTING | h(1) | h(2) | h(3) | h(4) |
|---|---|---|---|---|
| 2 | 0.8 | 0.2 | – | – |
| 3 | 0.7 | 0.2 | 0.1 | – |
| 4 | 0.6 | 0.2 | 0.1 | 0.1 |

OBJECT O
BACKGROUND B
t1
t2
t3
TIME

TRANSMITTANCE (%)
100
0
SPATIAL POSITION t1
t2
t3
TIME

BRIGHT NESS
2
0
TIME

SPATIAL POSITION
TIME 1062
1061
1063
1064
1065
BRIGHT NESS
1
0.5
SPATIAL POSITION

EMBODIMENT 1

CONVENTIONAL TECHNIQUE 1

CONVENTIONAL TECHNIQUE 2

OBJECT O
BACKGROUND B
t1
t2
t3
TIME

TRANSMITTANCE (%)
100
0
SPATIAL POSITION t1
t2
t3
TIME

BRIGHT NESS
2
0
TIME

SPATIAL POSITION
TIME 1082
1081
1083
1084

EMBODIMENT 1
BRIGHT NESS
1
SPATIAL POSITION

CONVENTIONAL TECHNIQUE 1
BRIGHT NESS
1
SPATIAL POSITION

CONVENTIONAL TECHNIQUE 2
BRIGHT NESS
1
0.5
SPATIAL POSITION

OBJECT O
BACKGROUND B
t1
t2
t3
TIME

TRANSMITTANCE (%)
100
0
SPATIAL POSITION t1
t2
t3
TIME

BRIGHT NESS
2
0
TIME

SPATIAL POSITION
TIME 1101
1104

EMBODIMENT 1

CONVENTIONAL ECHNIQUE 1

CONVENTIONAL TECHNIQUE 2

EMBODIMENT 1
BRIGHT NESS
1
0.5
SPATIAL POSITION

OBJECT O
BACKGROUND B
t1
t2
t3
TIME

TRANSMITTANCE (%)
100
0
SPATIAL POSITION

TIME

BRIGHT NESS
2
0
TIME

SPATIAL POSITION
TIME 1171
1174

EMBODIMENT 1

CONVENTIONAL TECHNIQUE 1

CONVENTIONAL TECHNIQUE 2
BRIGHT NESS
1
0.5
SPATIAL POSITION

OBJECT O
BACKGROUND B
t1
t2
t3
TIME

TRANSMITTANCE (%)
100
0
SPATIAL POSITION

TIME

BRIGHT NESS
2
0
TIME

SPATIAL POSITION
TIME 1111
1110

BRIGHT NESS
1
SPATIAL POSITION

OBJECT O
BACKGROUND B
t1
t2
t3
TIME

TRANSMITTANCE (%)
100
0
SPATIAL POSITION t1
t2
t3
TIME

BRIGHT NESS
0 1
TIME

SPATIAL POSITION
TIME

1501

BRIGHT NESS
1
SPATIAL POSITION

OBJECT O
BACKGROUND B
t1
t2
t3
TIME

TRANSMITTANCE (%)
100
0
SPATIAL POSITION

TIME

BRIGHT NESS
2
0
TIME

SPATIAL POSITION
TIME 1601
1602

BRIGHT NESS
1
SPATIAL POSITION

IMAGE DISPLAY APPARATUS AND CONTROL METHOD THEREFOR

BACKGROUND OF THE INVENTION

1. Field of the Invention

The present invention relates to an image display apparatus and a control method therefor.

2. Description of the Related Art

A hold-type image display apparatus, such as a liquid crystal display apparatus (liquid crystal display), incurs a phenomenon called "motion blur" by which a moving object is seen to have tailing in displaying a moving image.

There is a technique for improving the motion blur of such a liquid crystal display apparatus which is called "BL scan" which causes a backlight (BL) to perform impulse-type light emission (by black insertion, or inserting a black image between frames). For example, a technique exists such that in driving a backlight having a plurality of LEDs (light sources) arranged in a matrix form, BL lines of LEDs (matrix lines each formed of a plurality of LEDs) are sequentially lit and sequentially extinguished from the upper side toward the lower side of the screen. If the BL scan is performed only once per frame, a flicker disturbance occurs.

Conventional techniques for reducing the flicker disturbance are disclosed in Japanese Patent Application Laid-open Nos. 2000-322029 and 2008-65228 for example. Specifically, the techniques disclosed in Japanese Patent Application Laid-open Nos. 2000-322029 and 2008-65228 perform a control such as to light the backlight plural times per frame. Further, according to the technique disclosed in Japanese Patent Application Laid-open No. 2008-65228, the backlight is lit with different timings on a frame-to-frame basis.

However, when the techniques disclosed in Japanese Patent Application Laid-open Nos. 2000-322029 and 2008-65228 and the like are used, a double-image blur takes place by which the contour of an object is seen to be multiple. The following description is directed to the motion blur and the double-image blur.

Firstly, the motion blur is described with reference to FIGS. 16A to 16G. FIGS. 16A to 16G are schematic views illustrating an exemplary disturbance (motion blur) which occurs when the image of an object moving on the screen from the left-hand side toward the right-hand side is displayed without the BL scan.

FIG. 16A is a view illustrating an exemplary input image signal (image signal inputted to a liquid crystal display apparatus) which is inputted to a liquid crystal line A (matrix line formed of a plurality of liquid crystal elements) during three frame periods t1, t2 and t3. FIG. 16A illustrates an exemplary image signal indicative of a bright object O moving on a dark background B from the right-hand side toward the left-hand side of the screen.

FIG. 16B is a view illustrating an exemplary transmittance of a liquid crystal element forming the liquid crystal line A during the period t3. The ordinate of FIG. 16B represents the transmittance of the liquid crystal element, while the abscissa of FIG. 16B represents the spatial position (in the horizontal (transverse) direction) of the liquid crystal element. The transmittance corresponds to the brightness of an image.

FIG. 16C is a view illustrating an exemplary vertical sync signal with respect to the input image signal. Each of the periods t1, t2 and t3 is a one-frame period. The vertical sync signal is inputted once per one-frame period.

FIG. 16D is a view illustrating an exemplary lighting state of a backlight (a portion of the backlight corresponding to the liquid crystal line A). The ordinate of FIG. 16D represents time, while the abscissa of FIG. 16D represents the brightness of the backlight at each point in time (instantaneous value, i.e., instantaneous brightness). In FIG. 16D, the instantaneous brightness of the backlight is constantly set to 1.

FIG. 16E is a view illustrating an exemplary display image (image displayed on the screen) displayed on the liquid crystal line A during the three frame periods t1, t2 and t3 described above. The ordinate of FIG. 16E represents time, while the abscissa of FIG. 16E represents the spatial position. Because the backlight is always lit in FIG. 16E (see FIG. 16D), the image based on the input image signal is constantly displayed. In FIG. 16E, only the region of the object O is shown and the region of the background B is not shown.

FIG. 16F is a view illustrating an exemplary integration value of brightness which is inputted to the retinas of the eyes of a viewer, namely, an image perceived by the viewer (image on the liquid crystal line A) when the eyes of the viewer (user) follow the object O moving.

FIG. 16G is a view illustrating a distribution of the integration value shown in FIG. 16F (i.e., brightness distribution). When FIGS. 16B and 16G are compared to each other, the brightness of an edge portion of the object O changes steeply in FIG. 16B, whereas the brightness of an edge portion 1501 of the object O changes gently in FIG. 16G. This means that a blur (motion blur) occurs at the edge portion of the object O.

The next description is directed to the double-image blur with reference to FIGS. 17A to 17G. FIGS. 17A to 17G are schematic views illustrating an exemplary disturbance (including the motion blur and the double-image blur) which occurs when the image of an object moving on the screen from the left-hand side toward the right-hand side is displayed while the BL scan as disclosed in Japanese Patent Application Laid-open Nos. 2000-322029 and 2008-65228 is performed.

FIGS. 17A to 17C are identical with FIGS. 16A to 16C, respectively.

FIG. 17D is a view illustrating an exemplary lighting state of a backlight (a portion of the backlight corresponding to the liquid crystal line A). The ordinate of FIG. 17D represents time, while the abscissa of FIG. 17D represents the instantaneous brightness of the backlight at each point in time. In FIG. 17D, two lighting periods of the backlight are provided within one frame. The instantaneous brightness of the backlight in each lighting period is constantly set to 2. This is done in order to maintain the total amount of light emitted from the backlight during one frame.

FIG. 17E is an exemplary display image displayed on the liquid crystal line A during the three frame periods t1, t2 and t3. The ordinate of FIG. 17E represents time, while the abscissa of FIG. 17E represents the spatial position. In FIG. 17E, an image based on an input image signal is displayed during the lighting periods of the backlight (however, the brightness of the image is higher than in FIG. 16E), while a black image is displayed during non-lighting periods (extinction periods) of the backlight. This means that the image based on the input image signal and the black image are displayed alternately. In FIG. 17E, only the region of the object O is shown and the region of the background B is not shown.

FIG. 17F is a view illustrating an exemplary integration value of brightness which is inputted to the retinas of the eyes of a viewer, namely, an image perceived by the viewer (image on the liquid crystal line A) when the eyes of the viewer follow the object O moving.

FIG. 17G is a view illustrating a distribution of the integration value shown in FIG. 17F (i.e., brightness distribution). The change in the brightness of an edge portion 1601 of the object O is steeper in FIG. 17G than in FIG. 16G. This means that the blur (motion blur) that occurs at the edge portion of the object O is improved. In the example shown in FIG. 17G, however, the change in the brightness of the edge portion 1601 contains a flat portion 1602 which is a region in which the brightness stays constant. The brightness of a flat portion 1602 is a value at substantially the midpoint between the brightness of the background B and that of the object O. Such a flat portion brings about the double-image blur.

By performing only the BL scan disclosed in Japanese Patent Application Laid-open Nos. 2000-322029 and 2008-65228, the flicker disturbance and the motion blur can be reduced, but the double-image blur is allowed to occur.

A conventional technique for reducing such a double-image blur is disclosed in Japanese Patent Application Laid-open No. 2006-18200 for example. Specifically, the technique disclosed in Japanese Patent Application Laid-open No. 2006-18200 uses a lighting signal (backlight drive signal) which is the OR of a pulse signal given once per frame and a pulse signal given with a higher frequency than the frame frequency. The technique disclosed in Japanese Patent Application Laid-open No. 2006-18200 reduces the double-image blur by using such a lighting signal.

However, some display images relying upon the above-described techniques disclosed in Japanese Patent Application Laid-open Nos. 2000-322029, 2008-65228 and 2006-18200 allow the flicker disturbance to be visually observed because the number of times of lighting of the backlight within one frame is constant.

SUMMARY OF THE INVENTION

The present invention provides an image display apparatus which is capable of reducing the flicker disturbance, motion blur and double-image blur.

An image display apparatus according to the present invention comprises:

a light-emitting unit configured to emit light;

a display panel configured to display an image by transmitting the light from the light-emitting unit at a transmittance based on an input image signal; and a control unit configured to set a plurality of lighting periods respectively having different lengths on a frame-by-frame basis and control lighting and extinction of the light-emitting unit in such a manner that the light-emitting unit is lit during the lighting periods and extinguished during a period other than the lighting periods, wherein the control unit makes the number of lighting periods within one frame larger when a brightness of the image is bright than when the brightness of the image is dark.

A method of controlling an image display apparatus, according to the present invention, having a light-emitting unit configured to emit light and a display panel configured to display an image by transmitting the light from the light-emitting unit at a transmittance based on an input image signal, the method comprises:

a set step of setting a plurality of lighting periods respectively having different lengths on a frame-by-frame basis; and a control step of controlling lighting and extinction of the light-emitting unit in such a manner that the light-emitting unit is lit during the lighting periods and extinguished during a period other than the lighting periods, wherein in the set step, the number of lighting periods within one frame is made larger when a brightness of the image is bright than when the brightness of the image is dark.

According to the present invention, the flicker disturbance, motion blur and double-image blur can be reduced.

Further features of the present invention will become apparent from the following description of exemplary embodiments with reference to the attached drawings.

DESCRIPTION OF THE EMBODIMENTS

Hereinafter, embodiments of the present invention will be described. It should be noted that, though the following description is directed to a liquid crystal display apparatus and a control method therefor, an image display apparatus (and a control method therefor) according to the present invention is not limited to such a liquid crystal display apparatus (and a control method therefor). The image display apparatus according to the present invention may be any image display apparatus that includes a light-emitting unit configured to emit light and a display panel configured to display an image by transmitting the light from the light-emitting unit at a transmittance based on an input image signal.

Embodiment 1

Description will be made of a liquid crystal display apparatus and a control method therefor according to Embodiment 1 of the present invention.

Figure 1:
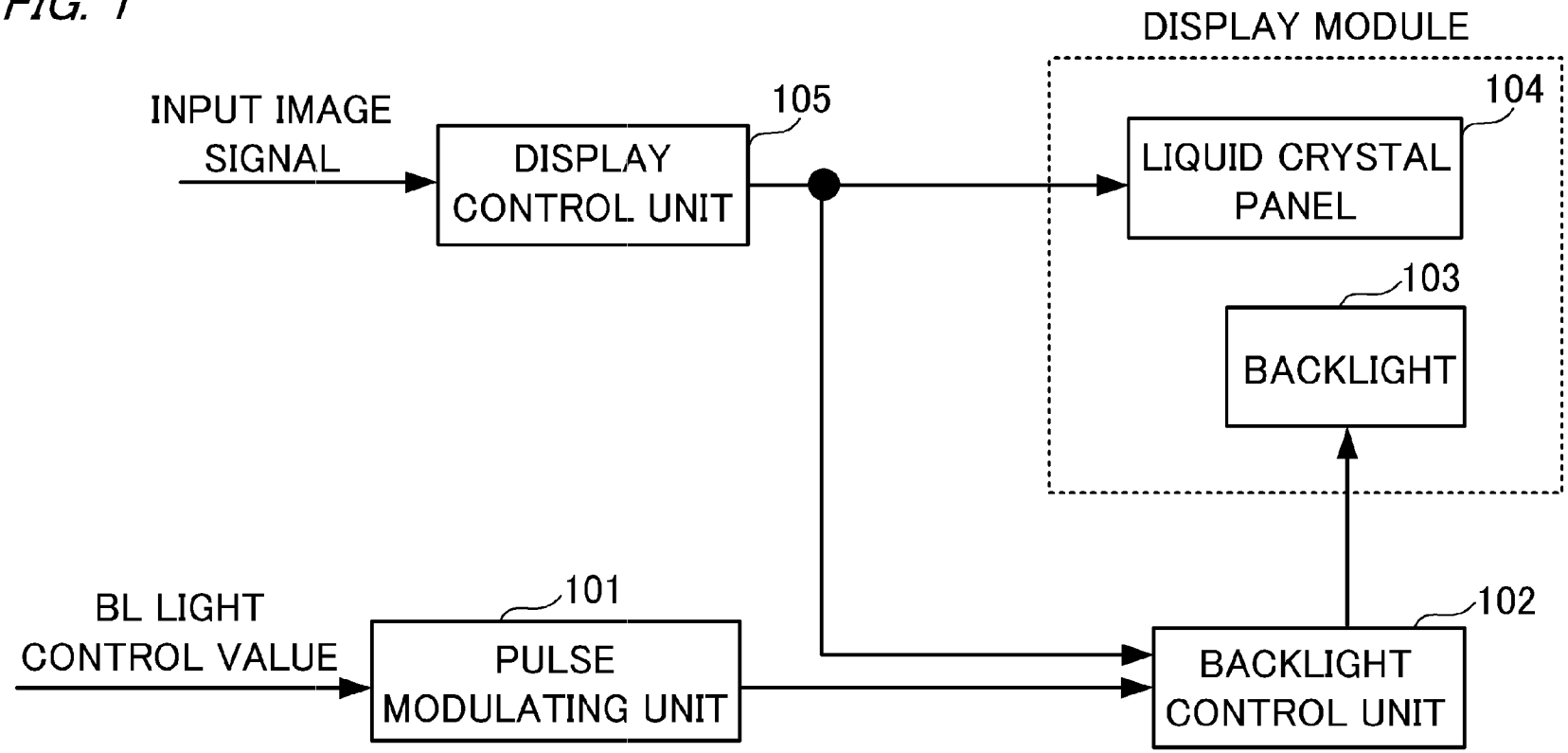
FIG. 1 illustrates an exemplary configuration of a liquid crystal display apparatus according to Embodiment 1.

FIG. 1 is a block diagram illustrating an exemplary configuration of a liquid crystal display apparatus according to the present embodiment.

As shown in FIG. 1, the liquid crystal display apparatus according to the present embodiment includes a pulse modulating unit 101, a backlight control unit 102, a backlight 103, a liquid crystal panel 104, a display control unit 105, and the like.

The liquid crystal panel 104 is a display panel having a plurality of liquid crystal elements of which the transmittances are controlled based on an input image signal.

The display control unit 105 controls the transmittances of the plural liquid crystal elements of the liquid crystal panel 104 based on the input image signal.

The backlight 103 is a light-emitting unit configured to emit light against the back side of the liquid crystal panel 104. In the present embodiment, the backlight 103 has a configuration capable of controlling lighting and extinction of blocks obtained by dividing the screen region of the liquid crystal panel 104 (i.e. dividing the image) on a block-by-block basis. Specifically, the backlight 103 has a plurality of LEDs arranged in a matrix form opposed to the back side of the liquid crystal panel 104 as light sources. In the present embodiment, the brightness of the backlight is variable.

There is no limitation to such a backlight. For example, an edge light type backlight may be used which includes a light guide plate having a plate surface opposed to the back side of the liquid crystal panel 104, and a light source provided on an edge portion of the light guide plate. The light source is not limited to an LED. For example, the light source may be a cold cathode tube.

The pulse modulating unit 101 sets a lighting period of the backlight. In the present embodiment, the pulse modulating unit 101 sets a plurality of lighting periods respectively having different lengths on a frame-by-frame basis. A method of setting a lighting period will be described later.

The backlight control unit 102 controls lighting and extinction of the backlight 103 in such a manner that the backlight 103 is lit during the lighting period of the backlight set by the pulse modulating unit 101 and extinguished during a period other than the lighting period. In the present embodiment, the period during which the backlight 103 is extinguished is referred to as an "extinction period".

In the present embodiment, the lighting period of LEDs belonging to each block is set on a block-by-block basis, while lighting and extinction of those LEDs belonging to the block concerned is controlled. Specifically, all the LEDs on one BL line (matrix line formed of a plurality of LEDs) form one block of LEDs. BL lines of LEDs are lit sequentially from the upper side toward the lower side of the screen.

In the present embodiment, the brightness of the backlight at each point in time within the lighting period (instantaneous value, i.e., instantaneous brightness) is a predetermined fixed value. The instantaneous brightness of the backlight may be determined by the display control unit 105 based on the input image signal or the like. For example, when the input image signal is a signal indicative of a dark image, the instantaneous brightness of the backlight may be lowered. By so doing, the total amount of light emission from the backlight during one frame is decreased, thereby lowering the brightness of the backlight in one frame. In such a case, the display control unit 105 may perform image processing of the input image signal based on the instantaneous brightness of the backlight and control the transmittance of each liquid crystal element based on the input image signal having been subjected to the image processing. For example, the display control unit 105 may perform image processing of the input image signal so as to prevent the brightness of the screen from being changed by the change in the brightness of the backlight based on the input image signal. With such an arrangement, it is possible to improve the contrast of an image and reduce the power consumption. The total time length of lighting periods within one frame may be determined based on the input image signal.

The following description is directed to the method of setting (determining) a lighting period of the backlight by the pulse modulating unit 101.

The pulse modulating unit 101 determines number n of times of lighting (frequency n of lighting) of the backlight within one frame (i.e., the number of lighting periods within one frame) and the length BLd(x) and start time BLp(x) of each lighting period by using a BL light control value BLa. x is an integer from 1 to n and represents a lighting period's turn. BLa represents the total time length of lighting periods within one frame. With increasing BLa value, the total time length of lighting periods within one frame becomes longer and, hence, the brightness of the backlight in one frame becomes higher (that is, the total amount of light emission of the backlight during one frame becomes larger). Stated otherwise, with decreasing BLa value, the total time length of lighting periods within one frame becomes shorter and, hence, the brightness of the backlight in one frame becomes lower (that is, the total amount of light emission of the backlight during one frame becomes smaller). BLd(x) represents the length of the $x^{th}$ lighting period of the plural lighting periods in one frame. BLp(x) represents the start time of the $x^{th}$ lighting period of the plural lighting periods in one frame.

Figure 2:
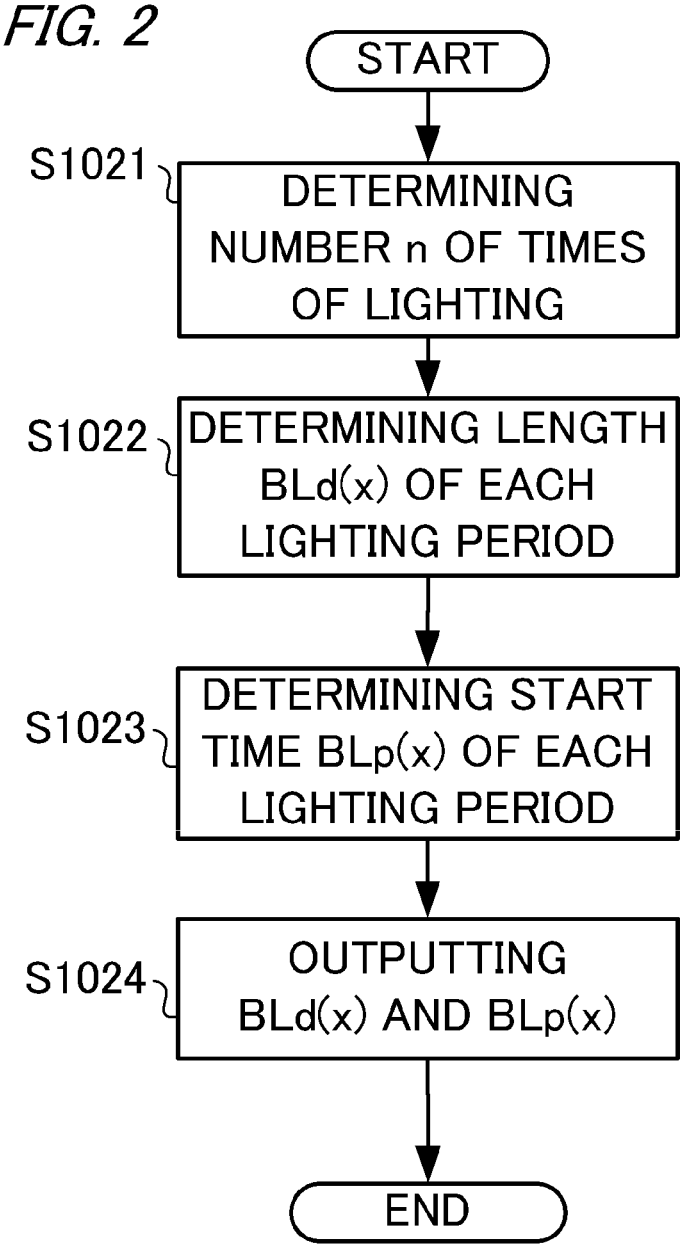
FIG. 2 illustrates an exemplary procedure for determining a lighting period according to Embodiment 1.

FIG. 2 is a flowchart illustrating an exemplary procedure for determining number n of times of lighting, the length BLd(x) of each lighting period and the start time BLp(x) of each lighting period.

Initially, the pulse modulating unit 101 determines number n of times of lighting such that the number of lighting periods within one frame becomes larger when the screen (a brightness of the image) is bright than when the screen is dark (step S1021). This is because the flicker disturbance can be visually observed more easily when the screen is bright than when the screen is dark. In the present embodiment, it is possible to suppress the motion blur and control the flicker disturbance precisely by making the number of lighting periods (number n of times of lighting) within one frame larger when the screen is bright than when the screen is dark. On the other hand, increasing number n of times lighting causes the double-image blur to be visually observed more easily. In the present embodiment, it is possible to suppress the double-image blur while suppressing the motion blur and the flicker disturbance by decreasing number n of times of lighting when the screen is dark.

In cases where the input image signal is indicative of a homochromatic image, the screen becomes brighter as the backlight becomes brighter (as the BL light control value BLa becomes larger). For this reason, the present embodiment determines number n of times of lighting with the brightness of the backlight being taken as the brightness of the screen. Since the instantaneous brightness of the backlight is a fixed value according to the present embodiment as described above, the brightness of the backlight in one frame is determined in accordance with the total time length of lighting periods within the frame concerned, namely, a set value of the BL light control value BLa. For this reason, number n of times of lighting is determined in accordance with the set value of the BL light control value BLa. This can realize the processing in step S1021 with a decreased processing amount. The BL light control value BLa is determined (or set) by a user's operation or based on an image display mode or the input image signal. For example, the BL light control value BLa is determined in accordance with a gradation value (e.g., mean gradation value) of the input image signal. Specifically, number n of times of lighting is determined using a function shown in FIG. 3 or table representing the relationship between the BL light control value BLa and number n of times of lighting. In the example illustrated in FIG. 3, number n of times of lighting is set larger when the BL light control value BLa is high than when the BL light control value BLa is low.

Figures 3, 4:
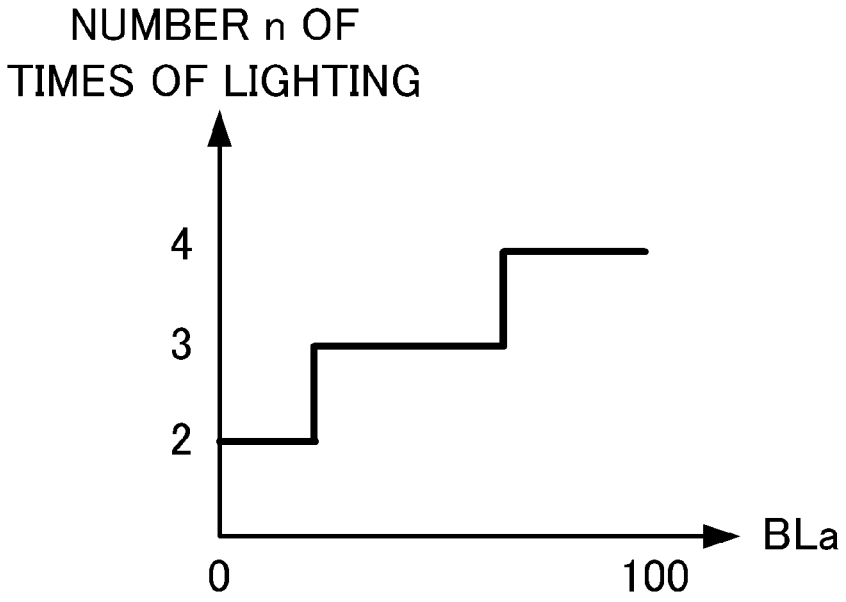
FIG. 3 illustrates an exemplary function representing the relationship between a BL light control value and the number of times of lighting.
FIG. 4 is an exemplary table showing an emission brightness ratio at each of the numbers of times of lighting.

Subsequently to step S1021, the pulse modulating unit 101 determines the length BLd(x) of each lighting period (step S1022). In the present embodiment, the length BLd(x) of each lighting period is calculated using Expression 1. In Expression 1, h(x) represents the emission brightness ratio of the backlight (the ratio of the total amount of light emission of the backlight during the $x^{th}$ lighting period in one frame to the total amount of light emission of the backlight in the frame concerned). The emission brightness ratio h(x) is determined using a predetermined table as shown in FIG. 4 (table representing the relationship between the value x and the emission brightness ratio h(x) for each of numbers n of times of lighting). In the example illustrated in FIG. 4, different values are set for h(1) to h(n). Therefore, BLd(1) to BLd(n) are different in value (length) from each other. Because the sum total of h(1) to h(n) is set to 1, the sum total of BLd(1) to BLd(n) is equal to BLa.

$$BLd(x)=h(x)\times BLa \quad \text{(Expression 1)}$$

Subsequently, the pulse modulating unit 101 determines the start time BLp(x) of each lighting period (step S1023). In the present embodiment, the start time BLp(x) of each lighting period is calculated using Expression 2. In Expression 2, Fa represents the length of one frame period.

$$BLp(x)=BLd(x-1)+BLp(x-1)+(Fa-BLa)/Gt \quad \text{(Expression 2)}$$

In the present embodiment, the start time of one frame period is set to 0 and the start time BLp(1) of the first (x=1) lighting period is set equal to 0.

In the present embodiment, Gt is set equal to n. By so setting, the lighting periods are determined such that extinction periods are uniform in length. By thus making the extinction periods uniform in length, the flicker disturbance can be reduced further than in cases where the extinction periods are not uniform in length.

By steps S1021 to S1023, the lighting periods within one frame are determined.

Subsequently, the pulse modulating unit 101 outputs to the backlight control unit 102 n number of lighting period lengths BLd(x) calculated in step S1022 and n number of start times BLp(x) calculated in step S1023 (step S1024). The backlight control unit 102 applies a drive current (BL drive current) to LEDs of the backlight 103 based on BLp(x) and BLd(x) inputted from the pulse modulating unit 101, thereby to light the LEDs.

Figure 5:
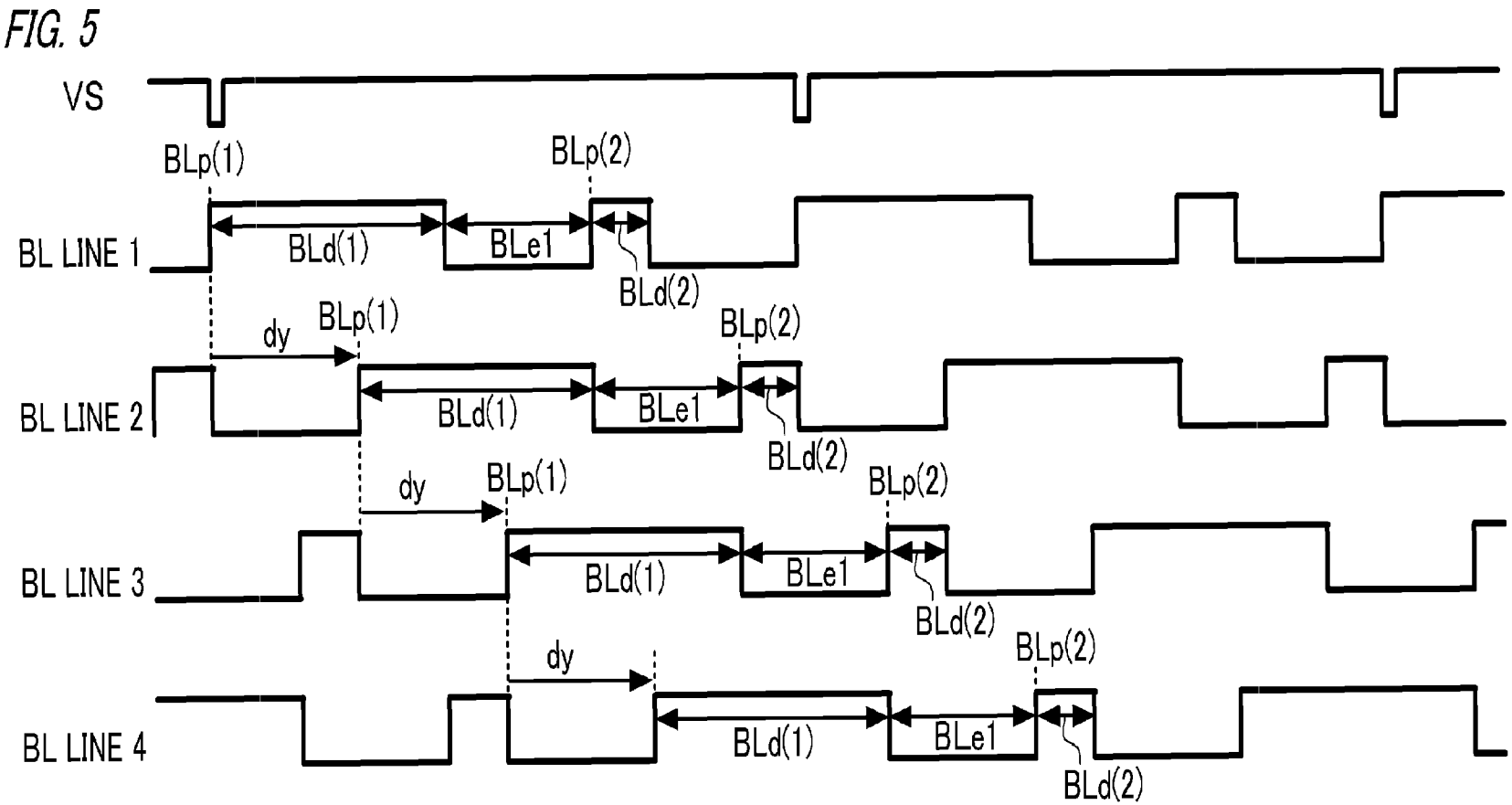
FIG. 5 illustrates an exemplary waveform of a BL drive current according to Embodiment 1.

FIG. 5 illustrates an exemplary waveform of a BL drive current (to be applied to LEDs) according to the present embodiment. In the example shown in FIG. 5, the number of rows (BL lines) of a matrix formed of a plurality of light sources (LEDs) is four. That is, FIG. 5 shows an arrangement in which the screen region is divided into four regions (blocks) aligned vertically. In FIG. 5, number n of times of lighting is 2.

The LEDs on BL line 1 (the uppermost BL line) are lit for a time period BLd(1) from the frame period start time (in the example illustrated in FIG. 5, the time at which a vertical sync signal VS is switched OFF). Thereafter, the LEDs on BL line 1 are extinguished for a time period BLe1. The LEDs on BL line 1 are then lit for a time period (2) from the time (BLp(2)) at which BLd(1)+BLe1 has elapsed from the frame period start time. In this way, the LEDs are lit twice in one frame. Lighting and extinction of the LEDs on BL lines 2 to 4 are controlled similarly to lighting and extinction of the LEDs on BL line 1. The start time and ending time of lighting of BL line 2 are each delayed by delay time dy from those of BL line 1. The start time and ending time of lighting of BL line 3 are each delayed by delay time dy from those of BL line 2. The start time and ending time of lighting of BL line 4 are each delayed by delay time dy from those of BL line 3. The delay time dy is calculated using Expression 3 for example.

$$dy=\text{one frame period/number of } BL \text{ lines} \quad \text{(Expression 3)}$$

Description will be made of effects of the present embodiment with reference to FIGS. 6A to 6I.

FIGS. 6A to 6I are schematic views illustrating exemplary effects brought about when the backlight is lit using the BL drive current illustrated in FIG. 5 to display the image of an object moving on the screen from the left-hand side toward the right-hand side.

Figures 6A, 6B, 6C, 6D, 6E, 6F, 6G, 6H, 6I:
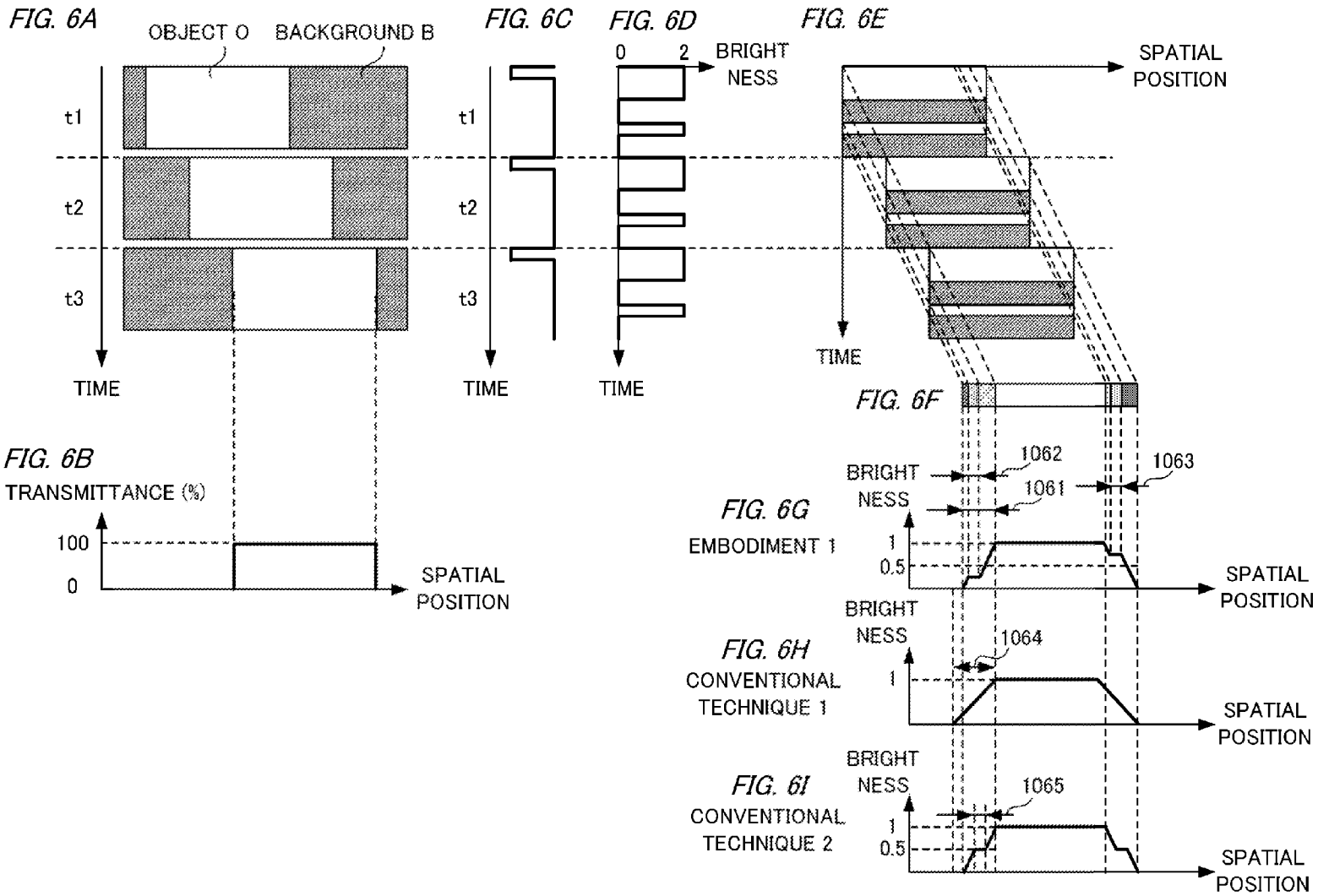
FIGS. 6A to 6I illustrate exemplary effects obtained when a backlight is lit by the BL drive current illustrated in FIG. 5.

FIG. 6A is a view illustrating an exemplary input image signal inputted to a liquid crystal line A (matrix line formed of a plurality of liquid crystal elements) during three frame periods t1, t2 and t3. FIG. 6A illustrates an exemplary image signal indicative of a bright object O moving on a dark background B from the right-hand side toward the left-hand side of the screen.

FIG. 6B is a view illustrating an exemplary transmittance of a liquid crystal element on the liquid crystal line A during period t3. The ordinate of FIG. 6B represents the transmittance of the liquid crystal element, while the abscissa of FIG. 6B represents the spatial position (in the horizontal (transverse) direction) of the liquid crystal element. The transmittance corresponds to the brightness of an image.

FIG. 6C is a view illustrating an exemplary vertical sync signal with respect to the input image signal. Each of the periods t1, t2 and t3 is a one-frame period. The vertical sync signal is inputted once per one-frame period.

FIG. 6D is a view illustrating an exemplary lighting state of the backlight (a portion of the backlight corresponding to the liquid crystal line A). The ordinate of FIG. 6D represents time, while the abscissa of FIG. 6D represents the instantaneous brightness of the backlight at each point in time. In FIG. 6D, two lighting periods are provided as the lighting periods of the backlight within one frame. The two lighting periods respectively have different lengths.

FIG. 6E is a view illustrating an exemplary display image (image displayed on the screen) displayed on the liquid crystal line A during the three frame periods t1, t2 and t3 described above. The ordinate of FIG. 6E represents time, while the abscissa of FIG. 6E represents the spatial position. In FIG. 6E, the image based on the input image signal is displayed during the lighting periods of the backlight (the portion of the backlight corresponding to the liquid crystal line A), while a black image is displayed during non-lighting periods (extinction periods). That is, the image based on the input image signal and the black image are displayed alternately. Specifically, the image based on the input image signal is displayed twice for different display time periods. In FIG. 6E, only the region of the object O is shown and the region of the background B is not shown.

FIG. 6F is a view illustrating an exemplary integration value of brightness which is inputted to the retinas of the eyes of a viewer, namely, an image perceived by the viewer (image on the liquid crystal line A) when the eyes of the viewer follow the object O moving.

FIG. 6G is a view illustrating a distribution of the integration value shown in FIG. 6F (i.e., brightness distribution).

Figures 16A, 16B, 16C, 16D, 16E, 16F, 16G:
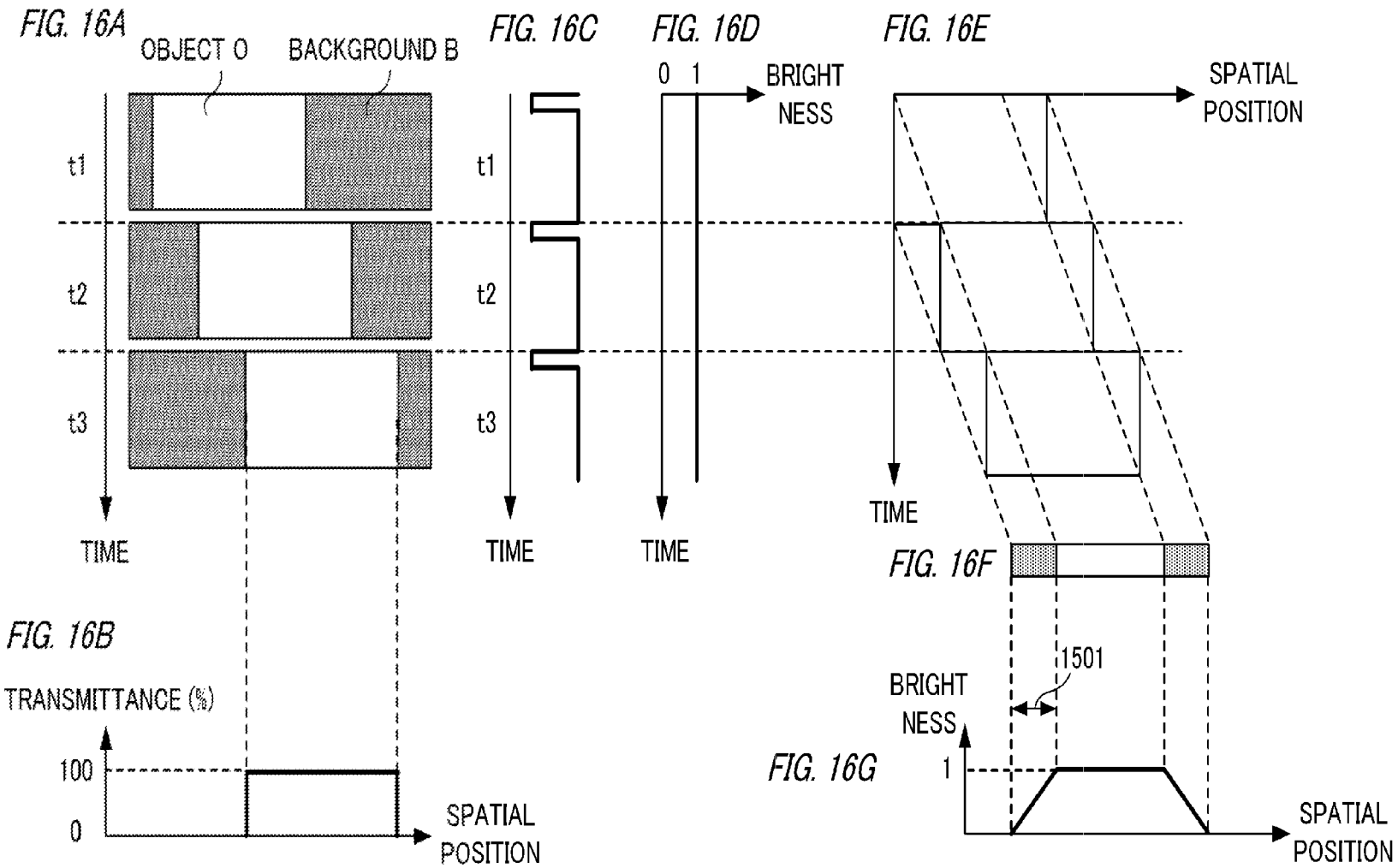
FIGS. 16A to 16G illustrate an exemplary disturbance which occurs when the BL scan is not performed.

FIGS. 6H and 6I are each a view illustrating a conventional brightness distribution. Specifically, FIG. 6H illustrates a brightness distribution obtained when the BL scan is not performed (see FIG. 16F). FIG. 6I illustrates a brightness distribution obtained when the conventional BL scan is performed (see FIG. 17F).

By providing the plurality of lighting periods (by dividing one lighting period into the plural lighting periods), the change in the brightness of an edge portion 1061 of the object O shown in FIG. 6G is made steeper than that in the brightness of an edge portion 1064 of the object O shown in FIG. 6H. For this reason, the present embodiment (FIG. 6G) is further improved in motion blur than the example shown in FIG. 6H.

By making the plural lighting periods respectively have different lengths, the brightness of a flat portion 1062 (i.e., a region of the edge portion in which the brightness is constant) shown in FIG. 6G assumes a value closer to the brightness of the background B than that of a flat portion 1065 shown in FIG. 6I. The brightness of a flat portion 1063 shown in FIG. 6G assumes a value closer to the brightness of the object O than that of the flat portion 1065 shown in FIG. 6I. By thus bringing the values of brightness of the flat portions closer to the brightness of the background and the brightness of the object, respectively, the double-image blur can be reduced as compared with cases where the brightness of a flat portion is a midpoint value (mean value) between the brightness of the background and that of the object.

As described above, the present embodiment makes the number of lighting periods within one frame larger when the screen is bright than when the screen is dark. This makes it possible to reduce the flicker disturbance precisely.

According to the present embodiment, the plural lighting periods within one frame are made different in length from one another. This arrangement can bring the brightness of a flat portion closer to the brightness of the background or object, thereby reducing the double-image blur.

According to the present embodiment, the lighting periods are set such that the extinction periods are made uniform in length. This makes the respective time periods for black image display uniform, thereby enabling the flicker disturbance to be reduced further.

There is no limitation to the above-described method of setting the lighting periods. The lighting periods may be set in any manner as long as the number of lighting periods within one frame is made larger when the screen is bright than when the screen is dark while the plural lighting periods within one frame are different in length from one another. For example, the length and the start time of each lighting period may be set by the user.

In the present embodiment, lighting and extinction of the backlight are controlled BL line by BL line. That is, all the light sources on each BL line form one block of light sources. However, there is no limitation to this arrangement. For example, all the light sources of the backlight may form one block of light sources. This means that all the light sources of the entire backlight may be lit and extinguished at a time. Alternatively, a single light source may be used as one block of light source.

In the present embodiment, number n of times of lighting remains invariant throughout the blocks. However, number n of times of lighting may differ between blocks. Specifically, number n of times of lighting of the backlight in a block may be determined in accordance with the brightness of the screen in the block concerned on a block-by-block basis. By so doing, the flicker disturbance can be reduced more precisely. Specifically, the flicker disturbance can be reduced on a block-by-block basis in harmonization with the characteristic of an image displayed in the block concerned.

In the present embodiment, number n of times of lighting is determined using the BL control value (brightness of the backlight in one frame) as the brightness of the screen in the frame concerned. However, there is no limitation to this method of determining number n of times of lighting. For example, the brightness of the screen in one frame may be calculated (predicted) specifically by using the BL control value and the input image signal (transmittance of each liquid crystal element).

In the present embodiment, the plurality of lighting periods are provided on a frame-by-frame basis. In cases where the input image signal is indicative of an image with a little motion, a plurality of lighting periods are provided plural frames by plural frames. In such a case, one lighting period may extend over two frames.

The lighting periods may be set such that the intervals between the lighting periods within one frame become shorter than the time length from the ending time of the last lighting period in the frame concerned to the ending time of the frame. That is, the intervals between the lighting periods within one frame may be set shorter than in the case of FIG. 5. This makes it possible to further reduce the motion blur and the double-image blur.

Such lighting periods can be set, for example, by making the value of Gt in Expression 2 larger than number n of times of lighting.

Figure 7:
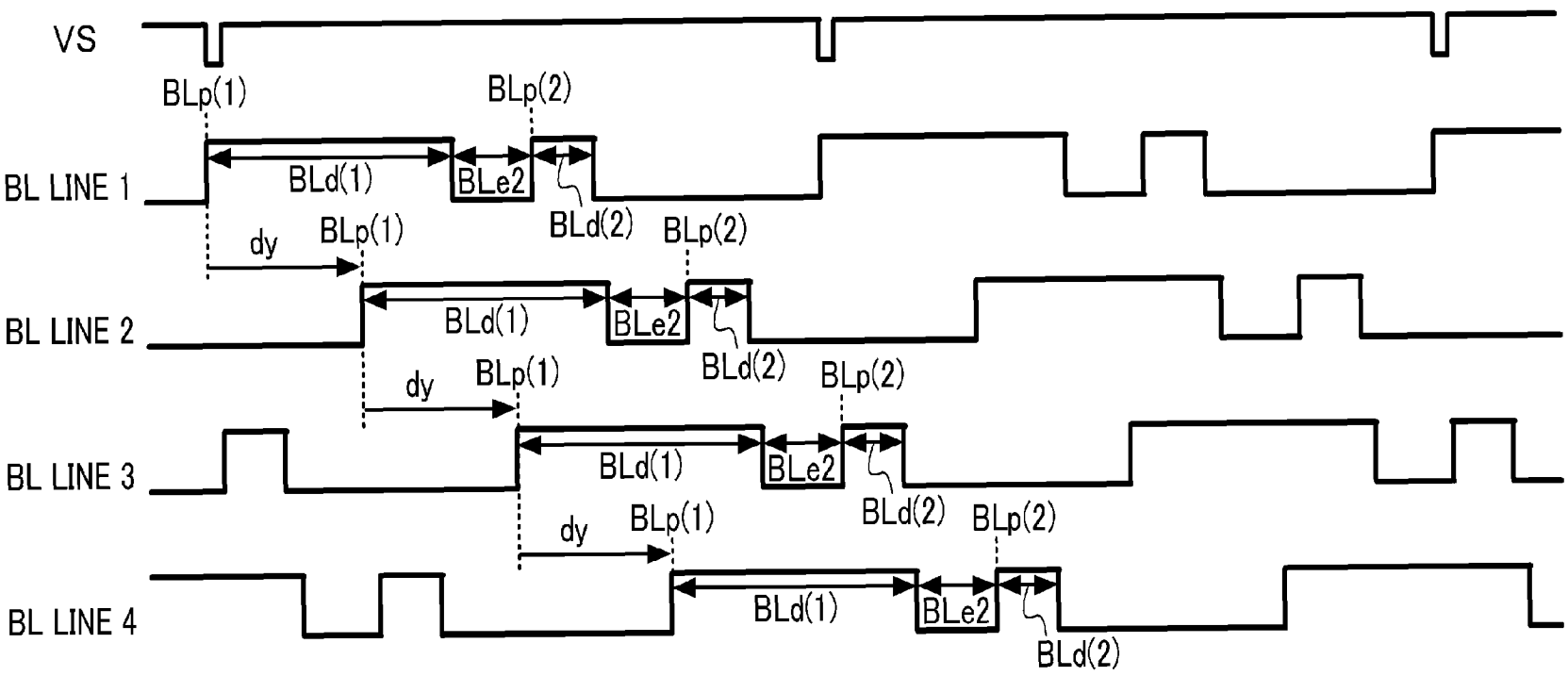
FIG. 7 illustrates an exemplary waveform of a BL drive current according to Embodiment 1.

FIG. 7 is a view illustrating an exemplary waveform of a BL drive current obtained when BLp(x) is calculated with number n of times of lighting set equal to 2 and the value of Gt set equal to 4. When the value of Gt is made larger than number n of times of lighting, the interval BLe2 between the first lighting period and the second lighting period becomes shorter than an interval (BLe1 of FIG. 5) obtained when the value of Gt is equal to number n of times of lighting. That is, the interval between the first lighting period and the second lighting period becomes shorter than the length of time from the ending time of the second lighting period to the ending time of the frame.

Description will be made of effects brought about when the backlight is driven by the BL drive current shown in FIG. 7 with reference to FIGS. 8A to 8I.

FIGS. 8A to 8I are schematic views illustrating exemplary effects brought about when the backlight is lit using the BL drive current illustrated in FIG. 7 to display the image of an object moving on the screen from the left-hand side toward the right-hand side.

FIGS. 8A to 8C, 8H and 8I are identical with FIGS. 6A to 6C, 6H and 6I, respectively.

Figures 8A, 8B, 8C, 8D, 8E, 8F, 8G, 8H, 8I:
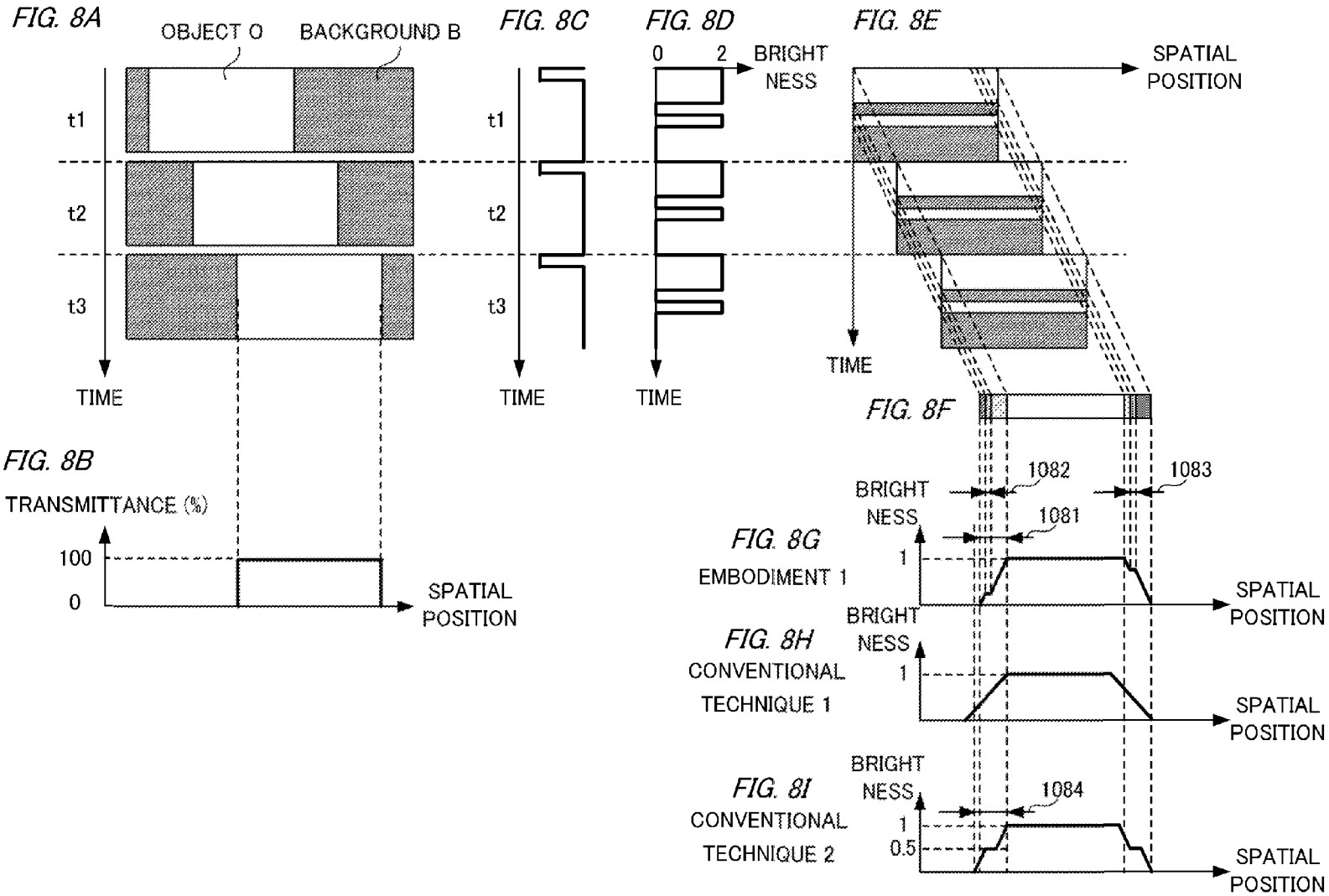
FIGS. 8A to 8I illustrate exemplary effects obtained when a backlight is lit by the BL drive current illustrated in FIG. 7.

FIG. 8D is a view illustrating an exemplary lighting state of the backlight (a portion of the backlight corresponding to the liquid crystal line A). The ordinate of FIG. 8D represents time, while the abscissa of FIG. 8D represents the instantaneous brightness of the backlight at each point in time. In FIG. 8D, two lighting periods are provided as the lighting periods of the backlight within one frame. The two lighting periods are different in length from each other. The interval between the first lighting period and the second lighting period is set shorter than in cases where the extinction periods are made uniform in length (see FIG. 6D).

FIG. 8E is a view illustrating an exemplary display image displayed on the liquid crystal line A during the three frame periods t1, t2 and t3. The ordinate of FIG. 8E represents time, while the abscissa of FIG. 8E represents the spatial position. In FIG. 8E, the image based on the input image signal is displayed during the lighting periods of the backlight, while a black image is displayed during non-lighting periods (extinction periods) of the backlight. That is, the image based on the input image signal and the black image are displayed alternately. Specifically, the image based on the input image signal is displayed twice for different display time periods. In FIG. 8E, only the region of the object O is shown and the region of the background B is not shown.

FIG. 8F is a view illustrating an exemplary integration value of brightness which is inputted to the retinas of the eyes of a viewer, namely, an image perceived by the viewer (image on the liquid crystal line A) when the eyes of the viewer follow the object O moving.

FIG. 8G is a view illustrating a distribution of the integration value shown in FIG. 8F (i.e., brightness distribution).

By providing the plurality of lighting periods while shortening the interval between the lighting periods within one frame, the change in the brightness of an edge portion 1081 of the object O shown in FIG. 8G is made steeper than that in the brightness of an edge portion 1084 of the object O shown in FIG. 8I. For this reason, the example shown in FIG. 8G is further improved in motion blur than the examples shown in FIGS. 8H and 8I.

By making the plural lighting periods respectively have different lengths, the example shown in FIG. 8G exhibits a reduced double-image blur like the example shown in FIG. 6G.

Further, by shortening the interval between the lighting periods within one frame, the dimensions of respective flat portions 1082 and 1083 in FIG. 8G are made smaller than in cases where the extinction periods are made uniform in length (see FIGS. 8I and 6G). For this reason, the example shown in FIG. 8G is further improved in double-image blur than in the cases where the extinction periods are made uniform in length (see FIGS. 8I and 6G).

The start time BLp(x) of each lighting period may be calculated using the following Expression 3. By adding a term "−BLd(x)/2" to Expression 2, the interval between the lighting periods within one frame can be shortened further.

$$BLp(x)=BLd(x-1)+BLp(x-1)+(Fa-BLa)/Gt-BLd(x)/2 \quad \text{(Expression 3)}$$

When providing three or more lighting periods within one frame, the lighting periods may be set such that the intervals between the lighting periods within the frame concerned become shorter gradually.

Such lighting periods can be simply set, for example, by gradually increasing the value of Gt in calculating the start time BLp(x).

Figure 9A:
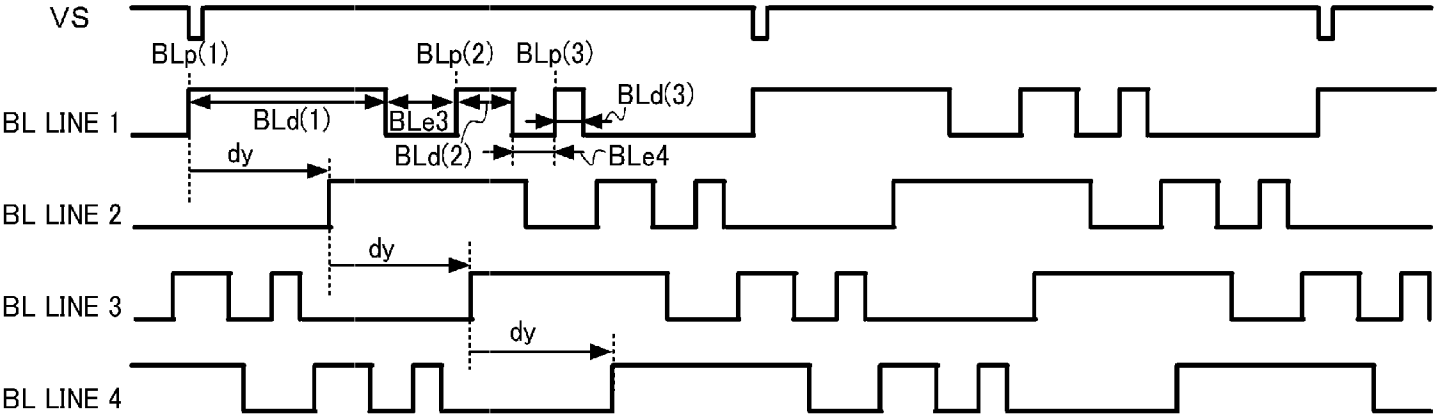
FIGS. 9A and 9B each illustrate an exemplary waveform of a BL drive current according to Embodiment 1.

FIG. 9A is a view illustrating an exemplary waveform of a BL drive current obtained when BLp(x) is calculated with number n of times of lighting set equal to 3. In FIG. 9A, BLe3 represents the interval between the first lighting period (i.e., the period having a length BLd(1)) and the second lighting period (i.e., the period having a length BLd(2)). BLe4 represents the interval between the second lighting period and the third lighting period (i.e., the period having a length BLd(3)). FIG. 9A illustrates the case where h1:h2:h3=0.7:0.2:0.1.

By calculating the start time BLp(x) with the value of Gt gradually increasing, the lighting periods are determined such that the intervals between the lighting periods within one frame become shorter gradually. Specifically, the length of the interval BLe4 is shorter than that of the interval BLe3.

Description will be made of effects brought about when the backlight is driven using the BL drive current shown in FIG. 9A with reference to FIGS. 10A to 10J.

FIGS. 10A to 10J are schematic views illustrating exemplary effects brought about when the backlight is lit using the BL drive current illustrated in FIG. 9A to display the image of an object moving on the screen from the left-hand side toward the right-hand side.

FIGS. 10A to 10C, 10H and 10I are identical with FIGS. 6A to 6C, 6H and 6I, respectively.

Figures 10A, 10B, 10C, 10D, 10E, 10F, 10G, 10H, 10I, 10J:
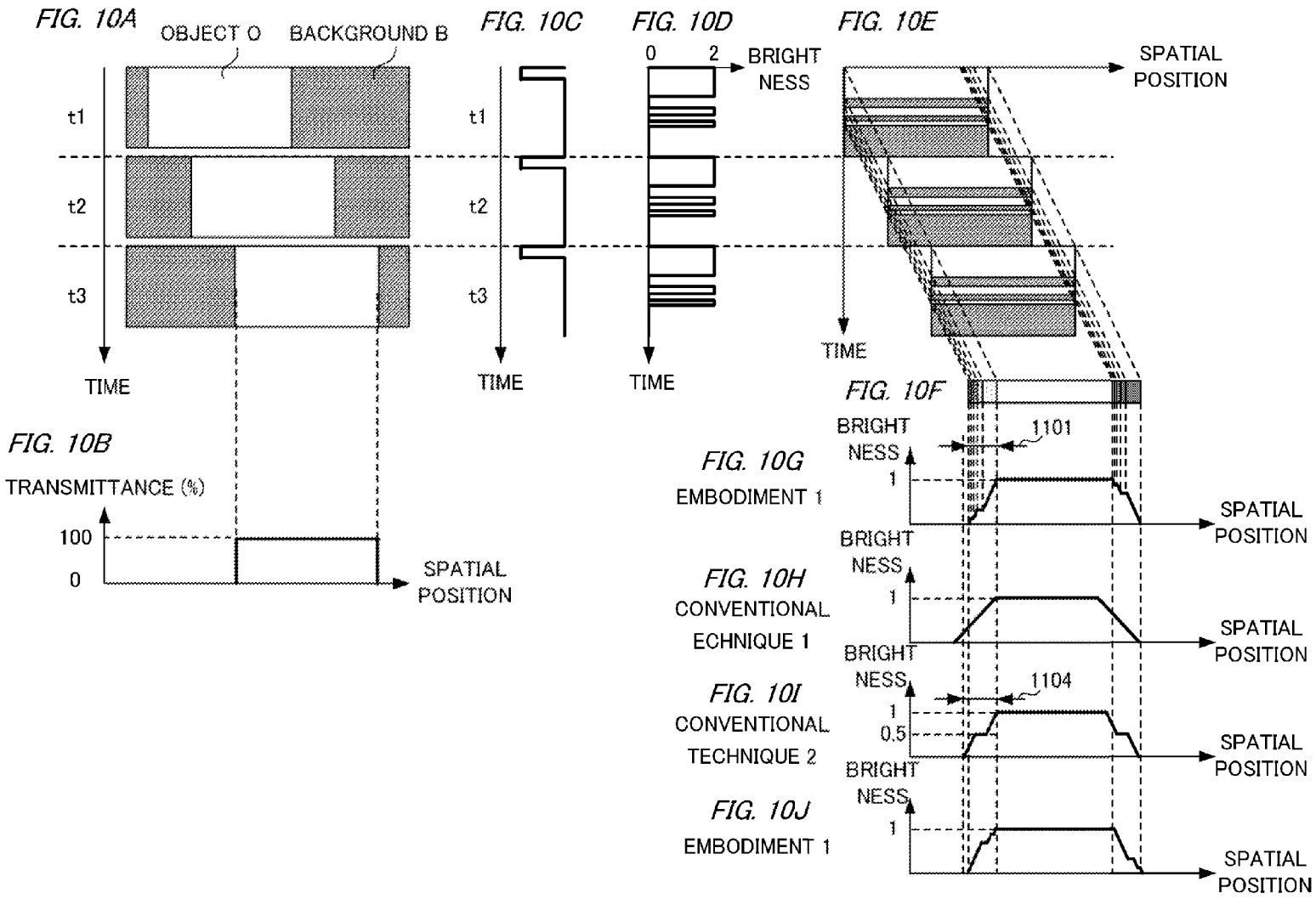
FIGS. 10A to 10J illustrate exemplary effects obtained when a backlight is lit by the BL drive current illustrated in FIG. 9A.

FIG. 10D is a view illustrating an exemplary lighting state of the backlight (a portion of the backlight corresponding to the liquid crystal line A). The ordinate of FIG. 10D represents time, while the abscissa of FIG. 10D represents the instantaneous brightness of the backlight at each point in time. In FIG. 10D, three lighting periods are provided as the lighting periods of the backlight within one frame. The three lighting periods are different in length from one another. Further, the length of the first non-lighting period (the interval between the first lighting period and the second lighting period) is made different from that of the second non-lighting period (the interval between the second lighting period and the third lighting period). Specifically, the length of the first non-lighting period is set shorter than that of the second non-lighting period. Further, the lengths of the first and second non-lighting periods are set shorter than that of the third non-lighting period (i.e., the length of time from the ending time of the third lighting period to the ending time of the frame). That is, the intervals between the lighting periods within one frame are set shorter than in cases where the extinction periods are made uniform in length, as in FIG. 8D.

FIG. 10E is a view illustrating an exemplary display image displayed on the liquid crystal line A during the three frame periods t1, t2 and t3. The ordinate of FIG. 10E represents time, while the abscissa of FIG. 10E represents the spatial position. In FIG. 10E, the image based on the input image signal is displayed during the lighting periods of the backlight, while a black image is displayed during the non-lighting periods (extinction periods) of the backlight. That is, the image based on the input image signal and the black image are displayed alternately. Specifically, the image based on the input image signal is displayed three times for different display time periods. In FIG. 10E, only the region of the object O is shown and the region of the background B is not shown.

FIG. 10F is a view illustrating an exemplary integration value of brightness which is inputted to the retinas of the eyes of a viewer, namely, an image perceived by the viewer (the image on the liquid crystal line A) when the eyes of the viewer follow the object O moving.

FIG. 10G is a view illustrating a distribution of the integration value shown in FIG. 10F (i.e., brightness distribution).

By providing the plurality of lighting periods while shortening the intervals between the lighting periods within one frame, the change in the brightness of an edge portion 1101 of the object O shown in FIG. 10G is made steeper than that in the brightness of an edge portion 1104 of the object O shown in FIG. 10I. For this reason, the example shown in FIG. 10G is further improved in motion blur than the examples shown in FIGS. 10I and 10H like the example shown in FIG. 8G.

By making the plural lighting periods respectively have different lengths, the example shown in FIG. 10G exhibits a reduced double-image blur like the example shown in FIG. 6G.

By providing the three lighting periods (by dividing one lighting period into three), the dimension of an inclined portion (a portion of an edge portion other than a flat portion)

shown in FIG. 10G is made smaller than in cases where two lighting periods are provided (by dividing one lighting period into two). Specifically, the dimension of an inclined portion is made smaller in FIG. 10G than in FIG. 8G. For this reason, the example shown in FIG. 10G is further improved in motion blur than the example shown in FIG. 8G.

By shortening the intervals between the lighting periods within one frame, the example shown in FIG. 10G is further improved in double-image blur than in cases where the extinction periods are made uniform in length, as in FIG. 8G.

Further, by gradually shortening the intervals between the lighting periods within one frame, plural flat portions of edge portions are made different in dimension from one another as shown in FIG. 10G. For this reason, the example shown in FIG. 10G can be expected to exhibit a further reduced double-image blur than in cases where the intervals between the lighting periods within one frame are made uniform.

When providing three or more lighting periods within one frame, the lighting periods may be set such that the intervals between the lighting periods within the frame concerned become longer gradually.

Such lighting periods can be simply set, for example, by gradually decreasing the value of Gt in calculating the start time BLp(x).

Figure 9B:
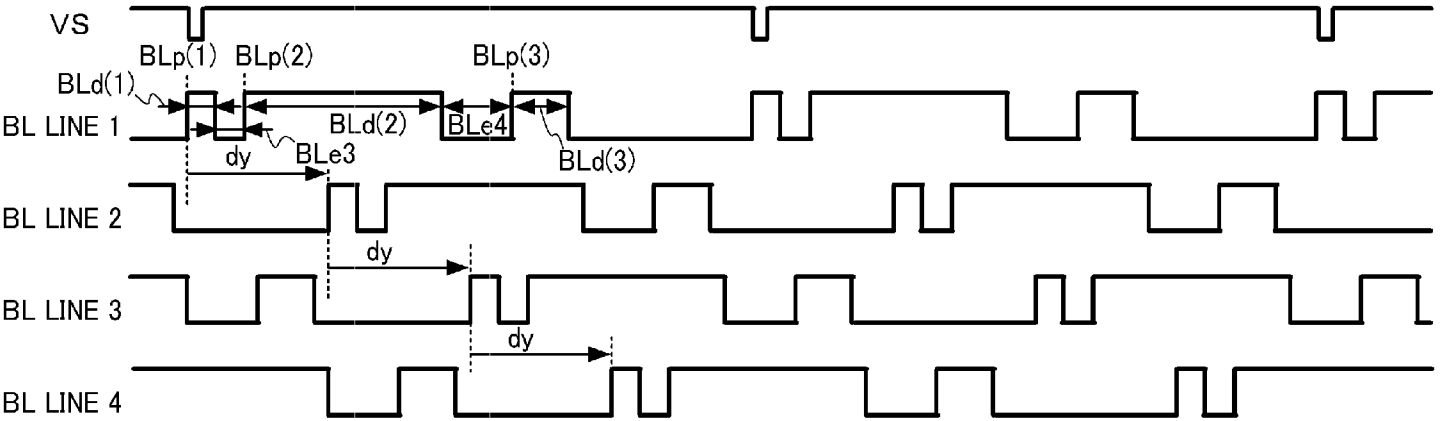

FIG. 9B is a view illustrating an exemplary waveform of a BL drive current obtained when BLp(x) is calculated with number n of times of lighting set equal to 3. In FIG. 9B, BLe3 represents the interval between the first lighting period (i.e., the period having a length BLd(1)) and the second lighting period (i.e., the period having a length BLd(2)). BLe4 represents the interval between the second lighting period and the third lighting period (i.e., the period having a length BLd(3)). FIG. 9B illustrates the case where h1:h2:h3=0.1:0.7:0.2. For this reason, the lighting periods are set such that a lighting period situated closer to the time coinciding with the center of the frame has a larger length as shown in FIG. 9B. Specifically, the three lighting periods are set such that the lighting period having the largest length intervenes between the other lighting periods.

By calculating the start time BLp(x) with the value of Gt gradually decreasing, the lighting periods are determined such that the intervals between the lighting periods within one frame become longer gradually. Specifically, the length of the interval BLe4 is longer than that of the interval BLe3.

Description will be made of effects brought about when the backlight is driven using the BL drive current shown in FIG. 9B with reference to FIGS. 11A to 11I.

FIGS. 11A to 11I are schematic views illustrating exemplary effects brought about when the backlight is lit using the BL drive current illustrated in FIG. 9B to display the image of an object moving on the screen from the left-hand side toward the right-hand side.

FIGS. 11A to 11C, 11H and 11I are identical with FIGS. 6A to 6C, 6H and 6I, respectively.

Figures 11A, 11B, 11C, 11D, 11E, 11F, 11G, 11H, 11I:
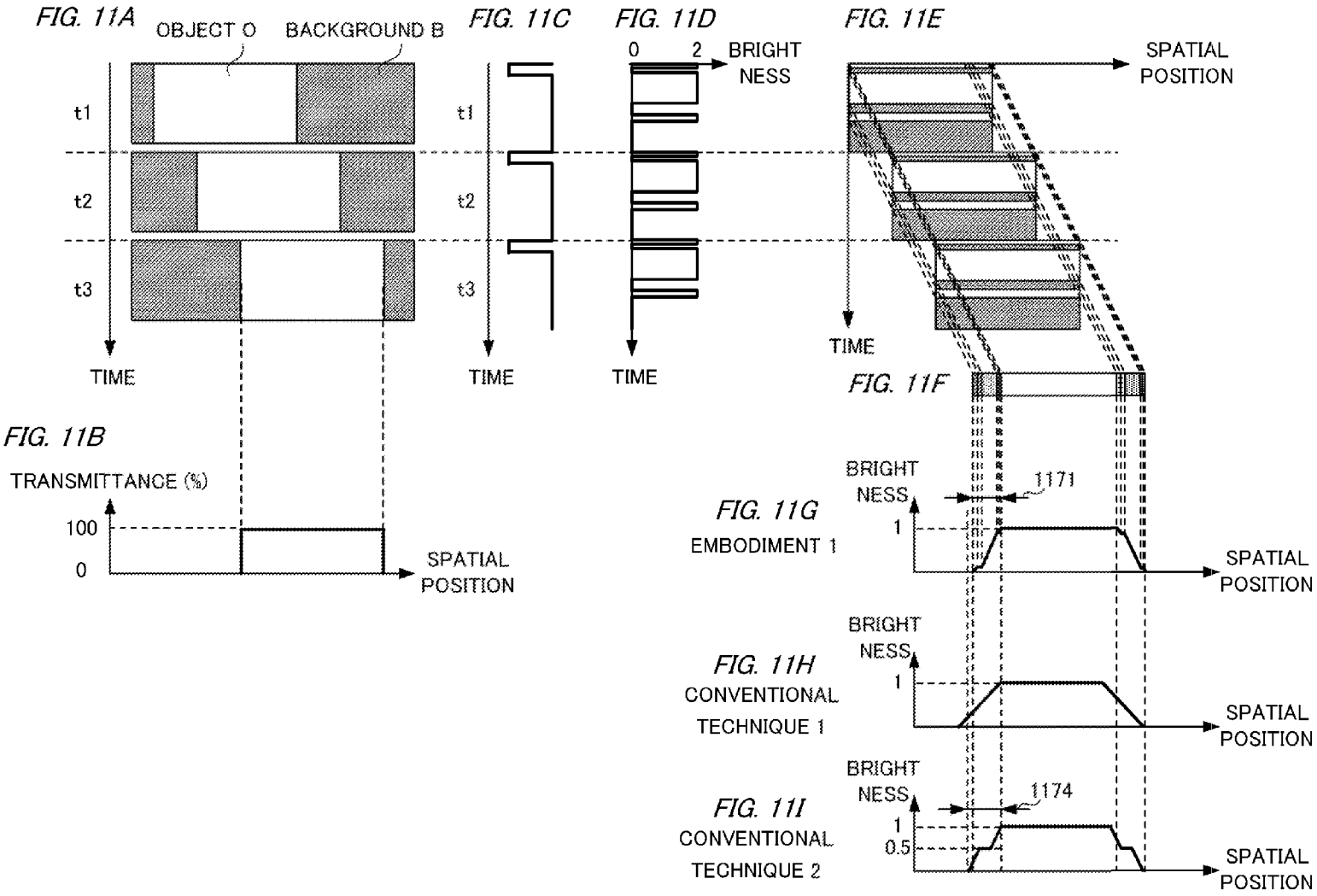
FIGS. 11A to 11I illustrate exemplary effects obtained when a backlight is lit by the BL drive current illustrated in FIG. 9B.

FIG. 11D is a view illustrating an exemplary lighting state of the backlight (a portion of the backlight corresponding to the liquid crystal line A). The ordinate of FIG. 11D represents time, while the abscissa of FIG. 11D represents the instantaneous brightness of the backlight at each point in time. In FIG. 11D, three lighting periods are provided as the lighting periods of the backlight within one frame. The three lighting periods are different in length from one another. Further, the length of the first non-lighting period (the interval between the first lighting period and the second lighting period) is made different from that of the second non-lighting period (the interval between the second lighting period and the third lighting period). Specifically, the length of the first non-lighting period is set longer than that of the second non-lighting period. Further, the lengths of the first and second non-lighting periods are set shorter than that of the third non-lighting period. That is, the intervals between the lighting periods within one frame are set shorter than in cases where the extinction periods are made uniform in length, as in FIG. 8D. The second one of the three lighting periods has the longest length.

FIG. 11E is a view illustrating an exemplary display image displayed on the liquid crystal line A during the three frame periods t1, t2 and t3. The ordinate of FIG. 11E represents time, while the abscissa of FIG. 11E represents the spatial position. In FIG. 11E, the image based on the input image signal is displayed during the lighting periods of the backlight, while a black image is displayed during the non-lighting periods (extinction periods) of the backlight. That is, the image based on the input image signal and the black image are displayed alternately. Specifically, the image based on the input image signal is displayed three times for different display time periods. In FIG. 11E, only the region of the object O is shown and the region of the background B is not shown.

FIG. 11F is a view illustrating an exemplary integration value of brightness which is inputted to the retinas of the eyes of a viewer, namely, an image perceived by the viewer (the image on the liquid crystal line A) when the eyes of the viewer follow the object O moving.

FIG. 11G is a view illustrating a distribution of the integration value shown in FIG. 11F (i.e., brightness distribution).

By providing the plurality of lighting periods while shortening the intervals between the lighting periods within one frame, the change in the brightness of an edge portion 1171 of the object O shown in FIG. 11G is made steeper than that in the brightness of an edge portion 1174 of the object O shown in FIG. 11I, as in FIG. 8G. For this reason, the example shown in FIG. 11G is further improved in motion blur than the examples shown in FIGS. 11I and 11H.

By making the plural lighting periods respectively have different lengths, the example shown in FIG. 11G exhibits a reduced double-image blur like the example shown in FIG. 6G.

By providing the three lighting periods, the example shown in FIG. 11G is further improved in motion blur than in cases where two lighting periods are provided (see FIG. 8G), as in FIG. 10G.

By shortening the intervals between the lighting periods within one frame, the example shown in FIG. 11G is further improved in double-image blur than in cases where the extinction periods are made uniform in length, as in FIG. 8G.

By gradually lengthening the intervals between the lighting periods within one frame, plural flat portions of edge portions are made different in dimension from one another as shown in FIG. 11G. For this reason, the example shown in FIG. 11G can be expected to exhibit a further reduced double-image blur than in cases where the intervals between the lighting periods within one frame are made uniform, as in FIG. 10G.

By making a lighting period situated closer to the time coinciding with the center of the frame have a larger length, the plural flat portions of the edge portions are separated into a flat portion having a brightness closer to the brightness of the background B and a flat portion having a brightness closer to the brightness of the object O. This makes it possible to bring the brightness of a flat portion closer to the brightness of the background B or object O, thereby to further reduce the double-image blur. For example, the brightness of a flat portion can be brought closer to the brightness of the background B or object O than in cases where the lighting period having the largest length is used as the first or last lighting period (see FIG. 10D), thereby further reducing the double-image blur. While number n of times of lighting is 3 in the example illustrated here, a similar effect can be obtained even when number n of times of lighting is more than 3 by increasing the length of a lighting period situated closer to the time coinciding with the center of the frame. When providing four lighting periods respectively having different lengths (lighting periods 1, 2, 3 and 4 in order of the longest one to the shortest one) for example, the four lighting periods are simply set such that the lighting periods 1 and 2 intervene between the lighting periods 3 and 4. When providing five lighting periods respectively having different lengths (lighting periods 1, 2, 3, 4 and 5 in order of the longest one to the shortest one), the five lighting periods are simply set such that the lighting period 1 intervenes between the lighting periods 2 and 3 while the lighting periods 1, 2 and 3 intervene between the lighting periods 4 and 5. By so doing, an effect similar to the above-described effect can be obtained.

FIGS. 9A and 9B, respectively, illustrate the arrangement in which the intervals between the lighting periods within one frame are shortened gradually and the arrangement in which the intervals between the lighting periods within one frame are lengthened gradually. However, there is no limitation to these arrangements. By setting the lighting periods such that the intervals between the lighting periods within one frame are different in length, the plural flat portions of the edge portions can be made different in dimension from one another, so that a further reduction in double-image blur can be expected than in cases where the intervals between the lighting periods within one frame are made uniform.

FIGS. 6G and 10G each illustrate an example in which the lengths of the lighting periods within one frame become shorter gradually. However, a similar effect can be obtained even when the lighting periods are set such that the lengths of the lighting periods within one frame become longer gradually.

FIGS. 12A to 12G are schematic views illustrating exemplary effects brought about when the backlight is lit by reversing the order of lighting periods shown in FIG. 5 to display the image of an object moving on the screen from the left-hand side toward the right-hand side.

Figures 12A, 12B, 12C, 12D, 12E, 12F, 12G:
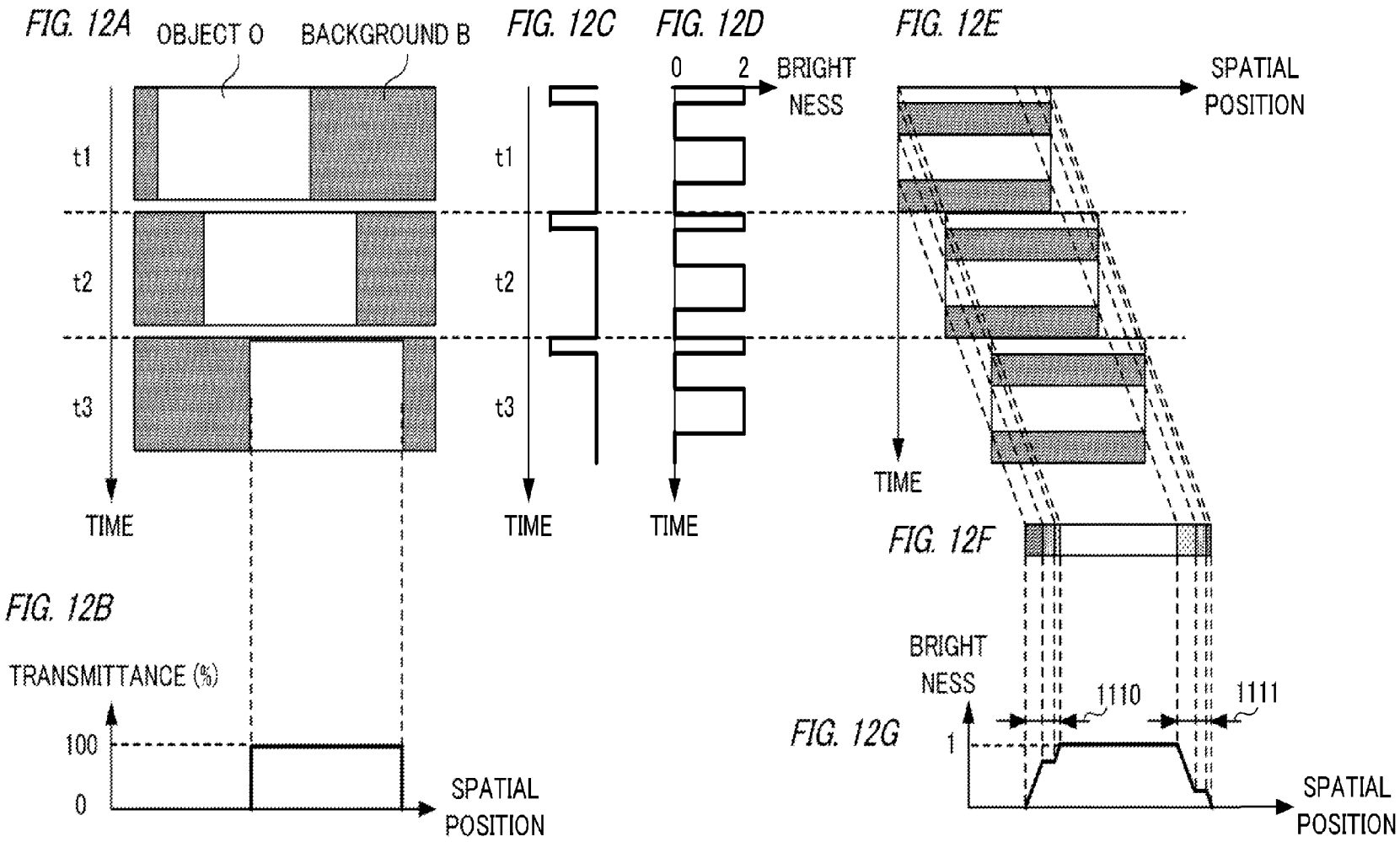
FIGS. 12A to 12G illustrate exemplary effects obtained when the sequence of the lighting periods shown in FIG. 5 is reversed.

FIGS. 12A to 12C are identical with FIGS. 6A to 6C, respectively.

FIG. 12D is a view illustrating an exemplary lighting state of the backlight (a portion of the backlight corresponding to the liquid crystal line A). In FIG. 12D, the length of the first lighting period is equal to that of the second lighting period shown in FIG. 6D, while the length of the second lighting period is equal to that of the second lighting period shown in FIG. 6D. FIGS. 12D and 6D are the same except these features.

FIG. 12E is a view illustrating an exemplary display image displayed on the liquid crystal line A during the three frame periods t1, t2 and t3. In FIG. 12E, the first display time period of the image based on the input image signal is equal to the second display time period shown in FIG. 6E, while the second display time period is equal to the first display time period shown in FIG. 6E. In FIG. 12E, only the region of the object O is shown and the region of the background B is not shown.

FIG. 12F is a view illustrating an exemplary integration value of brightness which is inputted to the retinas of the eyes of a viewer, namely, an image perceived by the viewer (the image on the liquid crystal line A) when the eyes of the viewer follow the object O moving.

FIG. 12G is a view illustrating a distribution of the integration value shown in FIG. 12F (i.e., brightness distribution).

By contrast to FIG. 6G in which the brightness of the flat portion of the left edge portion is brought close to the brightness of the background B, the brightness of a flat portion of a left edge portion 1110 is brought close to the brightness of the object O in FIG. 12G. Specifically, the brightness of the flat portion of the edge portion 1110 is equal to that of the flat portion of the right edge portion shown in FIG. 6G. By contrast to FIG. 6G in which the brightness of the flat portion of the right edge portion is brought close to the brightness of the object O, the brightness of a flat portion of a right edge portion 1111 is brought close to the brightness of the background B in FIG. 12G. Specifically, the brightness of the flat portion of the right edge portion 1111 is equal to that of the flat portion of the left edge portion shown in FIG. 6G. FIGS. 12G and 6G are the same except these features. That is, the brightness distribution shown in FIG. 12G is a transversely reversed distribution of the brightness distribution shown in FIG. 6G. Therefore, the example shown in FIG. 12G exercises an effect similar to that shown in FIG. 6G.

Even when number n of times of lighting is more than 2, the arrangement in which the lighting periods within one frame become longer gradually and the arrangement in which the lighting periods within one frame become shorter gradually are similar in effect to one another. FIG. 10J is a schematic view illustrating an exemplary brightness distribution obtained when the backlight is lit by reversing the order of lighting periods shown in FIG. 9A to display the image of an object moving on the screen from the left-hand side toward the right-hand side. The brightness distribution shown in FIG. 10J is a transversely reversed distribution of the brightness distribution shown in FIG. 10G. Therefore, the example shown in FIG. 10J exercises an effect similar to that shown in FIG. 10G.

Embodiment 2

Description will be made of a liquid crystal display apparatus and a control method therefor according to Embodiment 2 of the present invention. Description of components and features common to Embodiments 1 and 2 will be omitted.

Figure 13:
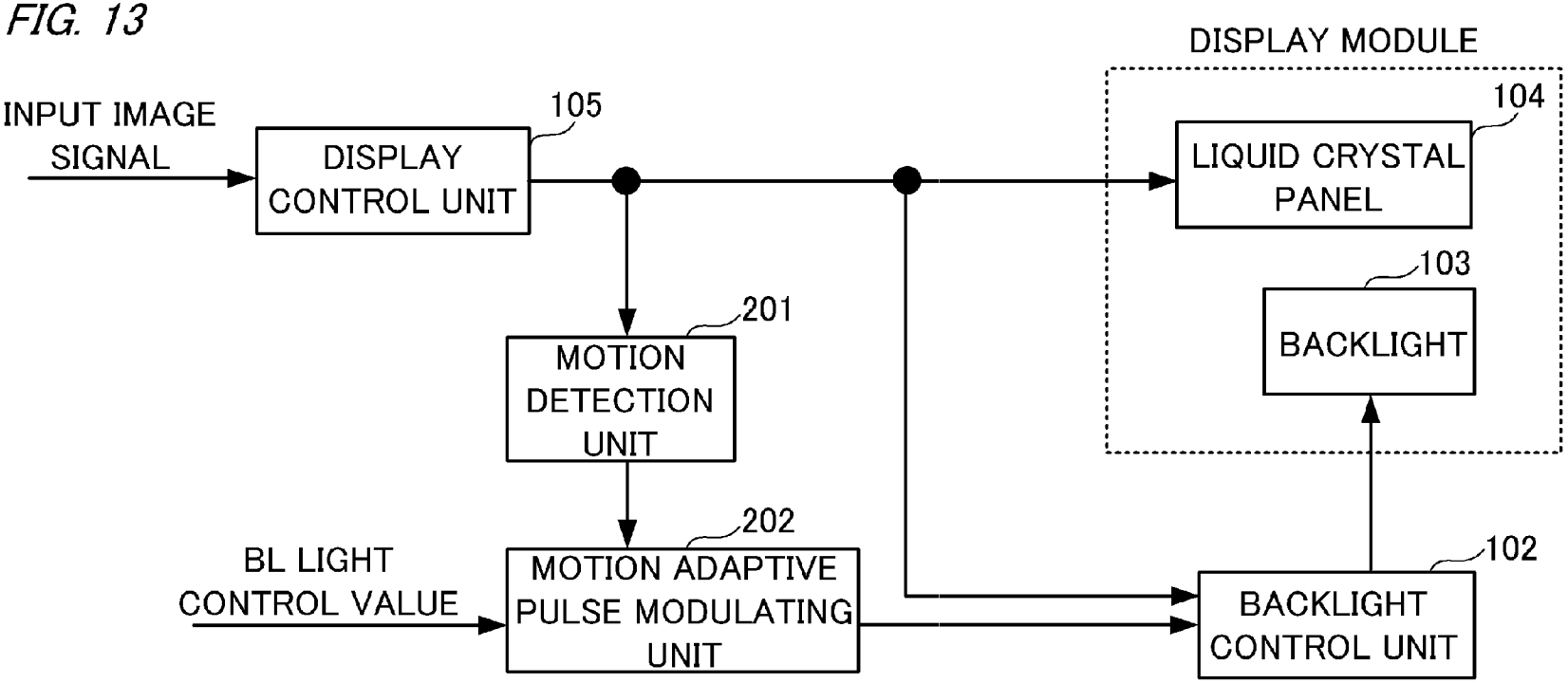
FIG. 13 illustrates an exemplary configuration of a liquid crystal display apparatus according to Embodiment 2.

FIG. 13 is a block diagram illustrating an exemplary configuration of a liquid crystal display apparatus according to the present embodiment.

As shown in FIG. 13, the liquid crystal display apparatus according to the present embodiment includes a motion detecting unit 201 and a motion adaptive pulse modulating unit 202 which replace the pulse modulating unit 101 of Embodiment 1.

The motion detecting unit 201 calculates the amount of motion of image between frames.

The motion adaptive pulse modulating unit 202 sets lighting periods of the backlight by using the amount of motion calculated by the motion detecting unit 201.

The following detailed description is directed to the process carried out by the motion detecting unit 201. Based on an input image signal, the motion detecting unit 201 calculates a motion determining value Sh indicative of the amount of motion of image between frames.

Figure 14:
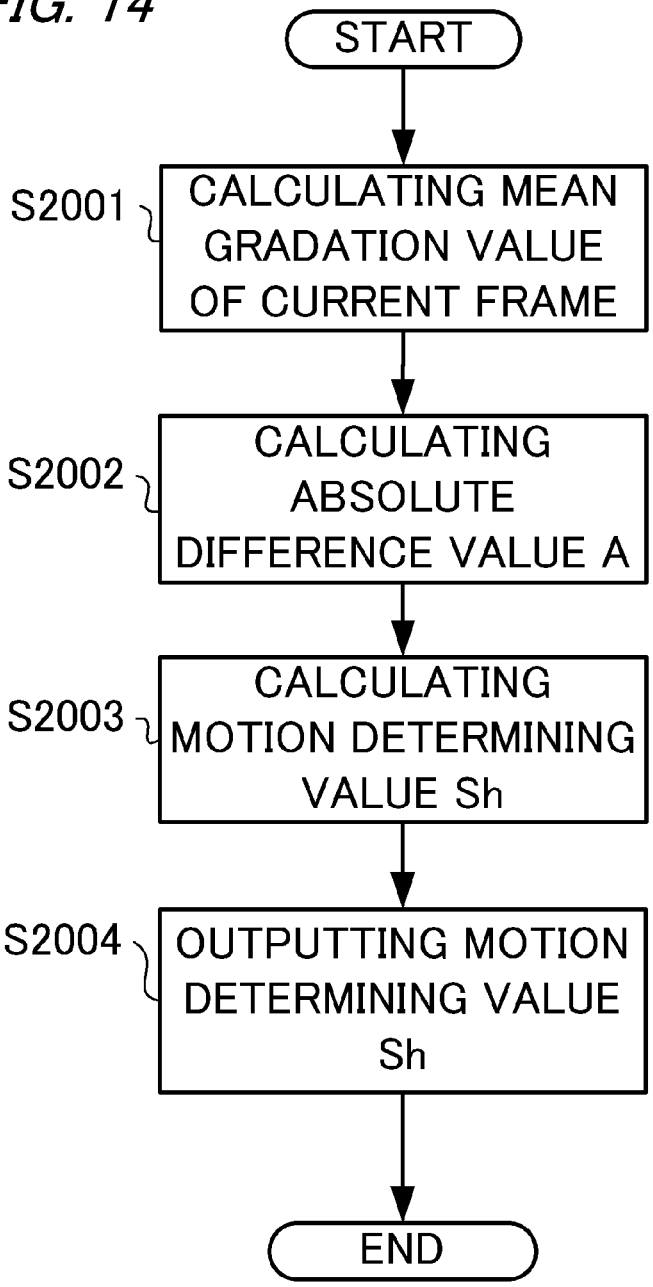
FIG. 14 illustrates an exemplary procedure for calculating a motion determining value.

FIG. 14 is a flowchart of an exemplary procedure for calculating the motion determining value Sh.

Initially, the motion detecting unit 201 calculates and stores the mean gradation value of the input image signal in a current frame (step S2001).

Subsequently, the motion determining unit 201 calculates the absolute value of a difference between the stored mean gradation value of the frame immediately preceding the current frame and the mean gradation value of the current frame (absolute difference value A) (step S2002).

Subsequently, the motion detecting unit 201 calculates the motion determining value Sh from the absolute difference value A calculated in step S2002 and a predetermined value Uth by using Expression 4 (step S2003).

$$Sh=A/Uth \quad \text{(Expression 4)}$$

The value A decreases with decreasing amount of motion and, hence, the value Sh decreases with decreasing amount of motion. Stated otherwise, the value A increases with increasing amount of motion and, hence, the value Sh increases with increasing amount of motion.

Subsequently, the motion detecting unit 201 outputs the motion determining value Sh calculated in step S1023 to the motion adaptive pulse modulating unit 202 (step S2004).

There is no limitation to the above-described method of calculating the amount of motion (motion determining value Sh). Any method can be used as long as the amount of motion can be determined. For example, a method is possible such that the mean gradation value of each of frames inputted at predetermined intervals is sampled and stored and then the amount of motion is calculated based on the amount of a change in the mean gradation value thus stored. Instead of the mean gradation value, use may be made of a most frequent gradation value, a gradation value histogram, a brightness histogram, or the like to calculate the amount of motion. Alternatively, it is possible to detect a motion vector of input image signal between frames and then calculate the amount of motion from the magnitude of the motion vector. However, calculation of the amount of motion based on the amount of a change in mean gradation value, most frequent gradation value, gradation value histogram or brightness histogram does not require detailed analysis of the input image signal and hence can reduce the processing load.

The following detailed description is directed to the process carried out by the motion adaptive pulse modulating unit 202. The motion adaptive pulse modulating unit 202 determines number n of times of lighting, the length BLd(x) of each lighting period, and the start time BLp(x) of each lighting period. Specifically, number n is determined as in Embodiment 1, while BLd(x) and BLp(x) are determined using the motion determining value Sh calculated by the motion detecting unit 201.

Figure 15:
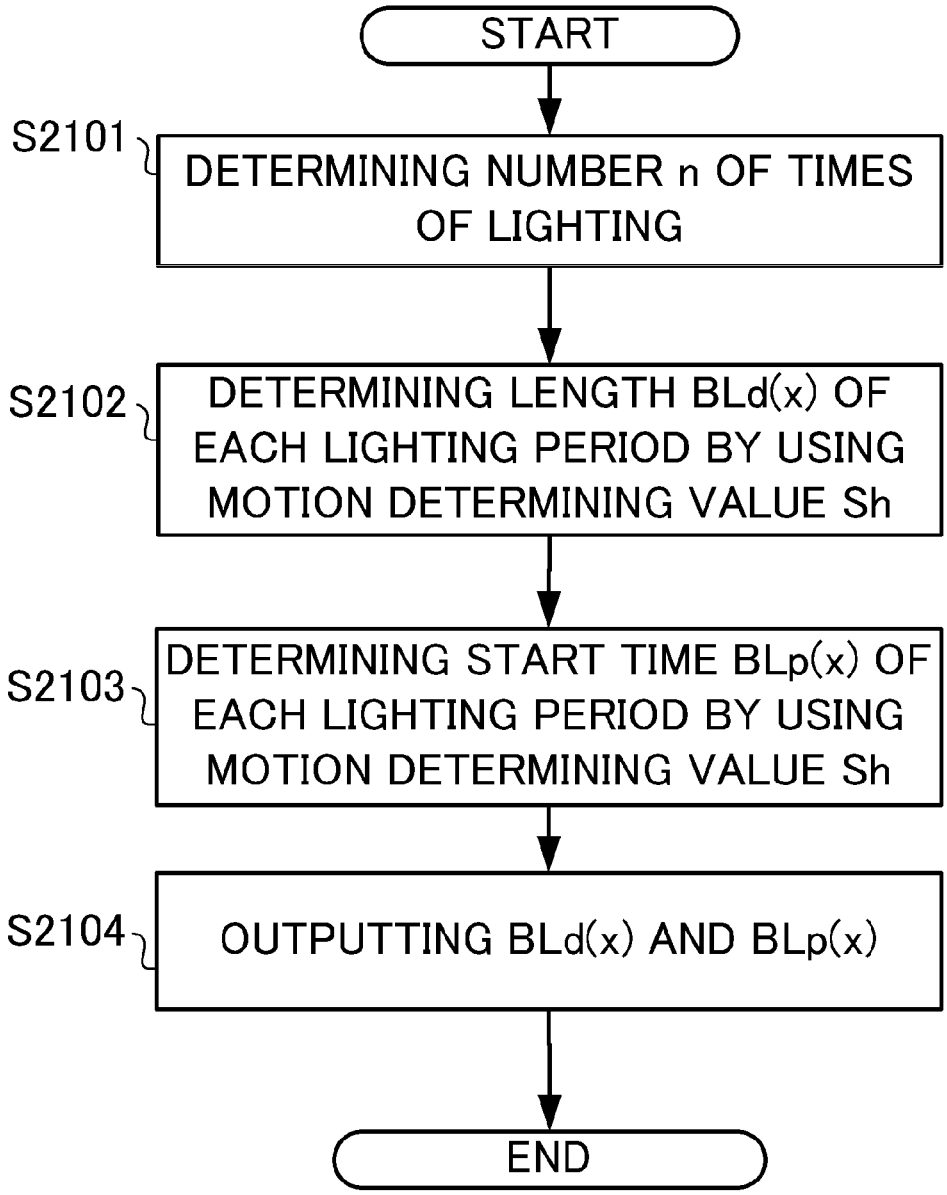
FIG. 15 illustrates an exemplary procedure for determining a lighting period according to Embodiment 2.

FIG. 15 is a flowchart of an exemplary procedure for determining number n of times of lighting, the length BLd(x) of each lighting period and the start time BLp(x) of each lighting period.

Initially, the motion adaptive pulse modulating unit 202 determines number n of times of lighting in accordance with a set value of the BL light control value BLa (step S2101). Since the method of determining number n of times of lighting is the same as in Embodiment 1, description thereof is omitted.

Subsequently, the motion adaptive pulse modulating unit 202 determines the length BLd(x) of each lighting period (step S2102). In the present embodiment, the lighting periods are set such that the difference in length among the lighting periods within one frame becomes larger when the amount of motion is large than when the amount of motion is small. Specifically, the motion adaptive pulse modulating unit 202 calculates the emission brightness ratio h(x) of each lighting period by using the following Expression 5.

[E1]

$$h(x)=(1-Sh)/\beta(x)+\alpha(x) \quad \text{(Expression 5)}$$

wherein $$h(1) = 1 - \sum_{i=2}^{n} h(i) \quad \text{(Expression 6)}$$

The length BLd(x) of each lighting period is then calculated using the emission brightness ratio h(x) thus calculated and Expression 1.

In Expression 5, β(x) and α(x) are constants for determining h(x). The values β(x) and α(x) are predetermined such that the difference in length among the lighting periods within one frame becomes larger when the amount of motion is large than when the amount of motion is small. For example, when number n of times of lighting is 2, β(1) and α(1) are set equal to 3.5 and 0.2, respectively. With such values, h(2) and h(1) are 0.49 and 0.51, respectively, when Sh=0 (that is, when the input image signal is a signal indicative of a still image) and, hence, the emission brightness ratios of the respective lighting periods are substantially uniform. When Sh=1 (that is, when the input image signal is a signal indicative of a moving image), h(2) and h(1) are 0.2 and 0.8 respectively. Therefore, the emission brightness ratios of the respective lighting periods are values largely different from each other. As a result, the difference in length among the lighting periods within one frame becomes larger when the amount of motion is large than when the amount of motion is small.

While the present embodiment is directed to the arrangement in which the difference in length among the lighting periods within one frame becomes larger with increasing amount of motion (i.e., the arrangement in which the lengths of the lighting periods change continuously in accordance with the amount of motion), there is no limitation to this arrangement. For example, the lengths of the lighting periods may change stepwise in accordance with the amount of motion.

Subsequently, the motion adaptive pulse modulating unit 202 determines the start time BLp(x) of each lighting period by using Expression 2, as in Embodiment 1 (step S2103). In the present embodiment, the start time BLp(x) is determined such that the intervals between the lighting periods within one frame become shorter when the amount of motion is large than when the amount of motion is small. Further, the start time BLp(x) is determined such that the extinction periods become more uniform in length when the amount of motion is small than when the amount of motion is large. Specifically, the value of Gt is determined using Expression 7 in step S2103.

$$Gt=n+\gamma\times Sh \quad \text{(Expression 7)},$$

where γ is a constant which determines the amount of a change in Gt value relative to the amount of a change in Sh value. According to Expression 7, Gt increases with increasing amount of motion (Sh). Therefore, Gt is brought closer to n with decreasing amount of motion (Sh). As a result, the intervals between the lighting periods within one frame become shorter with increasing amount of motion. The extinction periods become more uniform in length with decreasing amount of motion.

While the present embodiment is directed to the arrangement in which the intervals between the lighting periods change continuously in accordance with the amount of motion, there is no limitation to this arrangement. For example, the intervals between the lighting periods may change stepwise in accordance with the amount of motion.

When BLd(x) and BLp(x) are determined according to the above-described method in response to input of an input image signal indicative of a largely moving image, the resulting BL drive waveform is similar to that shown in FIG. 8D and, hence, the brightness distribution perceived by the viewer is similar to that shown in FIG. 8G. As a result, the motion blur and the double-image blur are intensively reduced when the input image signal is indicative of a largely moving image. Specifically, when the amount of motion is large, the difference in length among the lighting periods within one frame is increased, while the intervals between the lighting periods within one frame are shortened. Therefore, the motion blur and the double-image blur are reduced as in Embodiment 1.

Figures 17A, 17B, 17C, 17D, 17E, 17F, 17G:
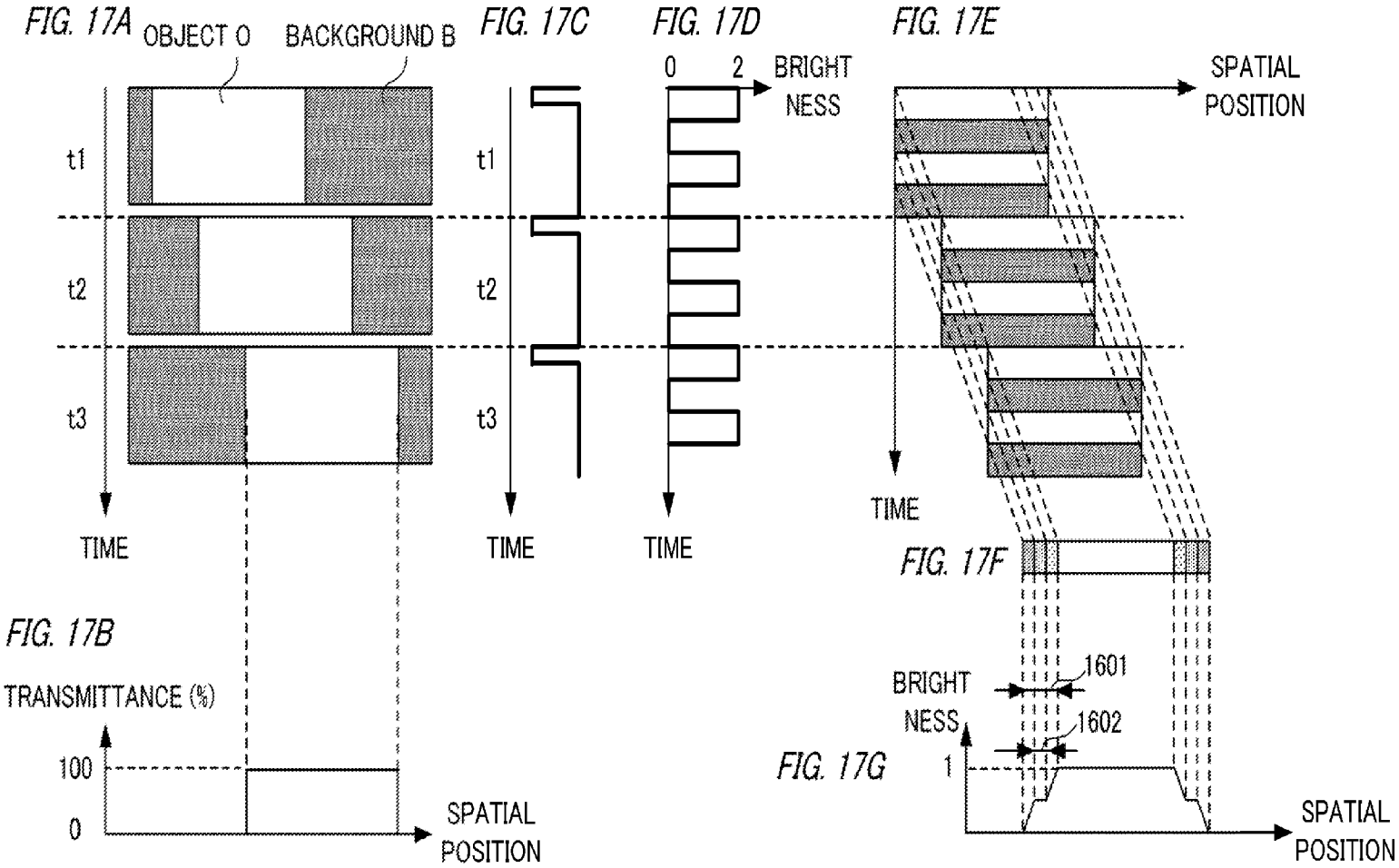
FIGS. 17A to 17G illustrate an exemplary disturbance which occurs when the conventional BL scan is performed.

On the other hand, when BLd(x) and BLp(x) are determined according to the above-described method in response to input of an input image signal indicative of an image in small motion, the resulting BL drive waveform is similar to that shown in FIG. 17D and, hence, the brightness distribution perceived by the viewer is similar to that shown in FIG. 17G. As a result, the flicker disturbance is intensively reduced when the input image signal is indicative of an image in small motion. Specifically, when the amount of motion is small, the lighting periods are made more uniform in length and, hence, display time periods for the image based on the input image signal are respectively made more uniform. Therefore, the flicker disturbance can be further reduced. In addition, when the amount of motion is small, the extinction periods are made more uniform in length and, hence, display time periods for the black image are respectively made uniform. Therefore, the flicker disturbance can be further reduced.

Subsequently to step S2103, the motion adaptive pulse modulating unit 202 outputs n number of lighting period lengths BLd(x) which have been calculated in step S2102 and n number of lighting period start times BLp(x) which have been calculated in step S2103 to the backlight control unit 102 (step S2104).

According to the present embodiment, the lighting periods are set using the amount of motion of image between frames, as described above. By so doing, the flicker disturbance, motion blur and double-image blur can be reduced more appropriately in accordance with input image signals.

Specifically, when the amount of motion of an image is large, the motion blur and the double-image blur make the viewer feel more disturbed than the flicker disturbance. When the amount of motion of an image is small, the flicker disturbance makes the viewer feel more disturbed than the motion blur and the double-image blur. As described above, when the amount of motion of an image is large, the present embodiment increases the difference in length among the lighting periods within one frame while shortening the intervals between the lighting periods within one frame. Therefore, the motion blur and the double-image blur can be reduced intensively. When the amount of motion is small, the present embodiment makes the lighting periods more uniform in length and also makes the extinction periods more uniform in length. Therefore, the flicker disturbance can be reduced intensively.

While the present embodiment is configured to determine the lengths of the lighting periods and the intervals between the lighting periods based on the amount of motion, only one of these factors may be determined based on the amount of motion.

The amount of motion may be calculated on a block-by-block basis. The lighting periods of the light sources may be set on a block-by-block basis by using the amount of motion of the block concerned. Such an arrangement makes it possible to reduce the flicker disturbance, motion blur and double-image blur more appropriately. Specifically, the flicker disturbance, motion blur and double-image blur can be reduced on a block-by-block basis in harmonization with the characteristic of the image displayed in the block concerned.

Embodiment 3

In Embodiment 1, number n of times of lighting is determined in accordance with the set value of the BL light control value BLa. In the present embodiment, the number of times of lighting (number n of times of lighting) is determined based on the format (specifically the frame rate) of an input image signal. Description of components and features common to Embodiments 1 and 3 will be omitted.

A liquid crystal display apparatus according to the present embodiment doubles the frame rate of an input image signal to display an image based on the input image signal when the frame rate of the input image signal is low. Specifically, the display control unit 105 of the present embodiment drives the liquid crystal panel with a drive frequency twice as high as the frame rate of the input image signal when the frame rate of the input image signal is low. Therefore, when the frame rate of the input image signal is low, the operation of displaying each frame of the input image signal twice successively is performed with a frequency twice as high as the frame rate of the input image signal. For example, when the frame rate of the input image signal is 24 Hz, the liquid crystal panel is driven with a drive frequency of 48 Hz.

The liquid crystal display apparatus according to the present embodiment fails to change the frame rate in displaying the image based on the input image signal when the frame rate of the input image signal is high. For example, when the frame rate of the input image signal is 60 Hz, the liquid crystal panel is driven with a drive frequency of 60 Hz.

Whether the frame rate of the input image signal is high or low can be determined, for example, by comparing the frame rate of the input image signal to a predetermined frame rate. Specifically, when the frame rate of the input image signal is lower than the predetermined frame rate (e.g., 30 Hz), the frame rate of the input image signal can be determined to be low. When the frame rate of the input image signal is higher than the predetermined frame rate, the frame rate of the input image signal can be determined to be high.

The liquid crystal display apparatus need not necessarily be imparted with such a frame rate changing function.

With such a configuration, when the frame rate of the input image signal is low, the frequency of switching of display image is low and, hence, the poor responsiveness of liquid crystal elements is hard to reflect on the screen (that is, the motion blur and the double-image blur are hard to appear). On the other hand, the flicker disturbance makes the viewer feel more disturbed. For example, when the frame rate of the input image signal is 24 Hz, the drive frequency for the liquid crystal panel is 48 Hz. However, each frame is displayed twice successively and, hence, switching of display image is performed with a frequency as low as 24 Hz.

In such a case, it is more important to reduce the flicker disturbance than the motion blur and double-image blur.

For this purpose, the present embodiment reduces the flicker disturbance more preferentially when the frame rate of the input image signal is low than when the frame rate of the input image signal is high. Specifically, the number of lighting periods within one frame is made larger when the frame rate of the input image signal is low than when the frame rate of the input image signal is high.

The following description is directed to specific examples.

In the present embodiment, the pulse modulating unit 101 determines number n of times of lighting such that "liquid crystal panel drive frequency×n≥lower limit flicker frequency". The lower limit flicker frequency is a threshold value for determining whether or not the flicker disturbance makes the viewer feel disturbed. In the present embodiment, the lower limit flicker frequency is a value determined by subjective evaluation. When the above-described frame rate changing is not carried out, the above-noted expression for calculating number n of times of lighting can be rewritten as "input image signal frame rate×n≥lower limit flicker frequency".

The pulse modulating unit 101 determines the lighting periods such that the extinction periods are made uniform in length (length of time from the ending time of the lighting period immediately preceding the current lighting period to the start time of the current lighting period) when the frame rate of the input image signal is low. The pulse modulating unit 101 may either acquire the result of determination as to whether or not the frame rate of the input image signal is low from the display control unit 105 or make such determination separately from the determination made by the display control unit 105.

The following is an exemplary relationship among the input image signal, frame rate, number n of times of lighting, Gt, and lower limit flicker frequency.

| Input image signal | Frame rate | number of times of lighting | Gt | Lower limit flicker frequency |
|---|---|---|---|---|
| Image signal 1 | 24 Hz | 4 | 4 | 150 |
| Image signal 2 | 60 Hz | 3 | 4 | 180 |

As can be seen from the relationship noted above, by increasing the number of times of lighting based on determination that the frame rate of 24 Hz is low, the flicker disturbance can be reduced precisely. Further, by making the intervals between the extinction periods uniform based on the determination that the frame rate is low, the flicker disturbance can be reduced intensively.

On the other hand, by setting Gt>n based on determination that the frame rate of 60 Hz is high, the motion blur and the double-image blur can be reduced intensively as in Embodiment 1.

The image signals 1 and 2 are different in lower limit flicker frequency from each other because the image sources of the respective signals are different from each other. For example, a subjectively preferred sensation of flicker differs between the case where the image source is a film source and the case where the image source is a TV source or a like source.

According to the present embodiment described above, the number of lighting periods within one frame is made larger when the frame rate of the input image signal is low than when the frame rate of the input image signal is high. By so doing, the flicker disturbance is reduced more preferentially when the frame rate of the input image signal is low than when the frame rate of the input image signal is high.

The value of the lower limit flicker frequency is not limited to those noted. The value of the lower limit flicker frequency may be set appropriately depending on the purpose and the like.

There is no limitation to the above-described method of determining number n of times of lighting. For example, it is possible to provide in advance a table indicative of number n of times of lighting for each frame rate or for each frame rate range and then determine number n of times of lighting by using the table.

Embodiment 4

The present embodiment is directed to a case where the number of times of lighting (number n of times of lighting) is determined based on the drive frequency for the liquid crystal panel. Description of components and features common to Embodiments 1 and 4 will be omitted.

When the drive frequency for the liquid crystal panel is low, the frequency of switching of display image is low and, hence, the poor responsiveness of liquid crystal elements is hard to reflect on the screen (that is, the motion blur and the double-image blur are hard to appear). On the other hand, the flicker disturbance makes the viewer feel more disturbed.

In such a case, it is more important to reduce the flicker disturbance than the motion blur and double-image blur.

For this purpose, the present embodiment reduces the flicker disturbance more preferentially when the liquid crystal panel drive frequency is low than when the liquid crystal panel drive frequency is high. Specifically, the number of lighting periods within one frame is made larger when the liquid crystal panel drive frequency is low than when the liquid crystal panel drive frequency is high.

The following description is directed to specific examples.

In the present embodiment, the pulse modulating unit 101 determines number n of times of lighting such that "liquid crystal panel drive frequency×n≥lower limit flicker frequency".

The pulse modulating unit 101 also determines the lighting periods such that the extinction periods are made uniform in length when the liquid crystal panel drive frequency is low.

Whether or not the liquid crystal panel drive frequency is low can be determined, for example, by comparing the liquid crystal panel drive frequency to a predetermined drive frequency. Specifically, when the liquid crystal panel drive frequency is lower than the predetermined frequency (e.g., 60 Hz), the liquid crystal panel drive frequency can be determined to be low. When the liquid crystal panel drive frequency is equal to or higher than the predetermined frequency, the liquid crystal panel drive frequency can be determined to be high.

The following is an exemplary relationship among the input image signal, liquid crystal panel drive frequency, number n of times of lighting, Gt, and lower limit flicker frequency.

| Input image signal | Drive frequency | number of times of lighting | Gt | Lower limit flicker frequency |
|---|---|---|---|---|
| Image signal 1 | 48 Hz | 4 | 4 | 150 |
| Image signal 2 | 50 Hz | 4 | 4 | 180 |
| Image signal 3 | 60 Hz | 3 | 4 | 180 |

As can be seen from the relationship noted above, by increasing the number of times of lighting based on determination that the drive frequencies of 48 Hz and 50 Hz are low, the flicker disturbance can be reduced precisely. Further, by making the intervals between the extinction periods uniform based on the determination that the drive frequencies are low, the flicker disturbance can be reduced intensively.

On the other hand, by setting Gt>n based on determination that the frame rate is high when the drive frequency is 60 Hz, the motion blur and the double-image blur can be reduced intensively as in Embodiment 1.

According to the present embodiment described above, the number of lighting periods within one frame is made larger when the display panel drive frequency is low than when the display panel drive frequency is high. By so doing, the flicker disturbance can be reduced more preferentially when the display panel drive frequency is low than when the display panel drive frequency is high.

There is no limitation to the above-described method of determining number n of times of lighting. For example, it is possible to provide in advance a table indicative of number n of times of lighting for each display panel drive frequency or for each drive frequency range and then determine number n of times of lighting by using the table.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-080930, filed on Mar. 30, 2012, which is hereby incorporated by reference herein in its entirety.

What is claimed is:

1. An image display apparatus comprising:

a display panel configured to display a moving image;

a light-emitting unit configured to emit light to the display panel; and a control unit configured to control lighting and extinction of the light-emitting unit for each frame of the moving image to be displayed on the display panel, wherein the control unit controls, for reducing blur of the moving image to be displayed on the display panel, lighting and extinction of the light-emitting unit in each frame such that at least two lighting period different in length from each other are included in each frame, in a case where a drive frequency for the display panel is a first frequency, the control unit controls lighting and extinction of the light-emitting unit in each frame such that a greater number of lighting periods than in a case where the drive frequency is a second frequency are included in one frame, wherein the second frequency is higher than the first frequency, and the control unit control lighting and extinction of the light-emitting unit in each frame such that an interval between the lighting periods within one frame is shorter than a length of time from an ending time of a last lighting period in the frame to an ending time of the frame.

2. The image display apparatus according to claim 1, wherein in a case where three or more lighting periods are included in one frame, the control unit control lighting and extinction of the light-emitting unit in the frame such that a lighting period which is closer to a time corresponding to a center of the frame becomes longer relative to the other lighting period in the frame.

3. The image display apparatus according to claim 1, wherein in a case where three or more lighting periods are included in one frame, the control unit control the lighting and extinction of the light-emitting unit in the frame such that intervals between the lighting periods within the frame are different in length from one another.

4. The image display apparatus according to claim 3, wherein in a case where three or more lighting periods are included in one frame, the control unit control lighting and extinction of the light-emitting unit in the frame such that the intervals between the lighting periods within the frame become shorter gradually.

5. The image display apparatus according to claim 3, wherein in a case where three or more lighting periods are included in one frame, the control unit control the lighting and extinction of the light-emitting unit in the frame such that the intervals between the lighting periods within the frame become longer gradually.

6. The image display apparatus according to claim 1, wherein the control unit control lighting and extinction of the light-emitting unit in each frame such that:

in a case where an amount of motion of image between frames is large, an interval between the lighting periods within one frame becomes shorter than a case where the amount of motion of image between frames is small; and in a case where an amount of motion of image between frames is small, extinction periods during which the light-emitting unit is extinguished become more uniform in length than a case where the amount of motion of image between frames is large.

7. The image display apparatus according to claim 1, wherein the control unit control lighting and extinction of the light-emitting unit in each frame such that, in a case where an amount of motion of image between frames is large, a difference in length among the lighting periods within one frame becomes larger than a case where the amount of motion of image between frames is small.

8. The image display apparatus according to claim 1, wherein the light-emitting unit has a configuration capable of controlling lighting and extinction for each of a plurality of divided regions constituting an area of a screen, and the control unit control the lighting periods for each divided region.

9. The image display apparatus according to claim 1, wherein in a case where a frame rate of an input image data is a first frame rate, the control unit control lighting and extinction of the light-emitting unit in each frame such that a greater number of lighting periods than in a case where the frame rate is a second frame rate are included in one frame, wherein the second frame rate is higher than the first frame rate.

10. The image display apparatus according to claim 9, wherein the second frame rate is 60 Hz.

11. The image display apparatus according to claim 1, wherein the second frequency is 60 Hz.

12. The image display apparatus according to claim 1, wherein the number of lighting periods in a case where the drive frequency is 48 Hz is equal to the number of lighting periods in a case where the drive frequency is 50 Hz.

13. The image display apparatus according to claim 1, wherein in a case where a brightness of an image to be displayed on the display panel is bright, the control unit control lighting and extinction of the light-emitting unit in each frame such that a greater number of lighting periods than in a case where the brightness of the image is dark are included in one frame.

14. The image display apparatus according to claim 13, wherein the light-emitting unit is capable of varying a brightness thereof, and the control unit control lighting and extinction of the light-emitting unit in each frame by using the brightness of the light-emitting unit as the brightness of the image.

15. The image display apparatus according to claim 1, wherein the control unit control lighting and extinction of the light-emitting unit in each frame such that:

a plurality of extinction periods during which the light-emitting unit is extinguished are included in one frame; and a last extinction period in the frame becomes longer than the other extinction period in the frame.

16. An image display apparatus comprising:

a display panel configured to display a moving image;

a light-emitting unit configured to emit light to the display panel; and a control unit configured to control lighting and extinction of the light-emitting unit for each frame of the moving image to be displayed on the display panel, wherein the control unit controls, for reducing blur of the moving image to be displayed on the display panel, lighting and extinction of the light-emitting unit in each frame such that at least two lighting period different in length from each other are included in each frame, in a case where a frame rate of an input image data is a first frame rate, the control unit controls lighting and extinction of the light-emitting unit in each frame such that a greater number of lighting periods than in a case where the frame rate is a second frame rate are included in one frame, wherein the second frame rate is higher than the first frame rate, and the control unit control lighting and extinction of the light-emitting unit in each frame such that an interval between the lighting periods within one frame is shorter than a length of time from an ending time of a last lighting period in the frame to an ending time of the frame.

17. The image display apparatus according to claim 16, wherein the second frame rate is 60 Hz.

18. The image display apparatus according to claim 16, wherein in a case where three or more lighting periods are included in one frame, the control unit control lighting and extinction of the light-emitting unit in the frame such that intervals between the lighting periods within the frame are different in length from one another.

19. The image display apparatus according to claim 18, wherein in a case where three or more lighting periods are included in one frame, the control unit control lighting and extinction of the light-emitting unit in the frame such that the intervals between the lighting periods within the frame become shorter gradually.

20. The image display apparatus according to claim 18, wherein in a case where three or more lighting periods are included in one frame, the control unit control lighting and extinction of the light-emitting unit in the frame such that the intervals between the lighting periods within the frame become longer gradually.

21. The image display apparatus according to claim 16, wherein in a case where a brightness of an image to be displayed on the display panel is bright, the control unit control lighting and extinction of the light-emitting unit in each frame such that a greater number of lighting periods than in a case where the brightness of the image is dark are included in one frame.

22. The image display apparatus according to claim 21, wherein the light-emitting unit is capable of varying a brightness thereof, and the control unit control lighting and extinction of the light-emitting unit in each frame by using the brightness of the light-emitting unit as the brightness of the image.

23. The image display apparatus according to claim 16, wherein in a case where three or more lighting periods are included in one frame, the control unit control lighting and extinction of the light-emitting unit in the frame such that a lighting period which is closer to a time corresponding to a center of the frame becomes longer relative to the other lighting period in the frame.

24. The image display apparatus according to claim 16, wherein the control unit control lighting and extinction of the light-emitting unit in each frame such that:

in a case where an amount of motion of image between frames is large, an interval between the lighting periods within one frame becomes shorter than a case where the amount of motion of image between frames is small; and in a case where an amount of motion of image between frames is small, extinction periods during which the light-emitting unit is extinguished become more uniform in length than a case where the amount of motion of image between frames is large.

25. The image display apparatus according to claim 16, wherein the control unit control lighting and extinction of the light-emitting unit in each frame such that, in a case where an amount of motion of image between frames is large, a difference in length among the lighting periods within one frame becomes larger than a case where the amount of motion of image between frames is small.

26. The image display apparatus according to claim 16, wherein the light-emitting unit has a configuration capable of controlling lighting and extinction for each of a plurality of divided regions constituting an area of a screen, and the control unit control the lighting periods for each divided region.

27. The image display apparatus according to claim 16, wherein the control unit control lighting and extinction of the light-emitting unit in each frame such that:

a plurality of extinction periods during which the light-emitting unit is extinguished are included in one frame; and a last extinction period in the frame becomes longer than the other extinction period in the frame.

28. An image display apparatus comprising:

a display panel configured to display a moving image;

a light-emitting unit configured to emit light to the display panel; and a control unit configured to control lighting and extinction of the light-emitting unit for each frame of the moving image to be displayed on the display panel, wherein the control unit controls, for reducing blur of the moving image to be displayed on the display panel, lighting and extinction of the light-emitting unit in each frame such that at least two lighting period different in length from each other are included in each frame, in a case where a drive frequency for the display panel is a first frequency, the control unit controls lighting and extinction of the light-emitting unit in each frame such that a greater number of lighting periods than in a case where the drive frequency is a second frequency are included in one frame, wherein the second frequency is higher than the first frequency, and in a case where three or more lighting periods are set within one frame, the control unit control lighting and extinction of the light-emitting unit in the frame such that a lighting period which is closer to a time corresponding to a center of the frame becomes longer relative to the other lighting period in the frame.

29. The image display apparatus according to claim 28, wherein in a case where three or more lighting periods are included in one frame, the control unit control lighting and extinction of the light-emitting unit in the frame such that intervals between the lighting periods within the frame are different in length from one another.

30. The image display apparatus according to claim 29, wherein in a case where three or more lighting periods are included in one frame, the control unit control lighting and extinction of the light-emitting unit in the frame such that the intervals between the lighting periods within the frame become shorter gradually.

31. The image display apparatus according to claim 29, wherein in a case where three or more lighting periods are included in one frame, the control unit control lighting and extinction of the light-emitting unit in the frame such that the intervals between the lighting periods within the frame become longer gradually.

32. The image display apparatus according to claim 28, wherein the control unit control lighting and extinction of the light-emitting unit in each frame such that:

in a case where an amount of motion of image between frames is large, an interval between the lighting periods within one frame becomes shorter than a case where the amount of motion of image between frames is small; and in a case where an amount of motion of image between frames is small, extinction periods during which the light-emitting unit is extinguished become more uniform in length than a case where the amount of motion of image between frames is large.

33. The image display apparatus according to claim 28, wherein the control unit control lighting and extinction of the light-emitting unit in each frame such that, in a case where an amount of motion of image between frames is large, a difference in length among the lighting periods within one frame becomes larger than a case where the amount of motion of image between frames is small.

34. The image display apparatus according to claim 28, wherein the light-emitting unit has a configuration capable of controlling lighting and extinction for each of a plurality of divided regions constituting an area of a screen, and the control unit control the lighting periods for each divided region.

35. The image display apparatus according to claim 28, wherein in a case where a frame rate of an input image data is a first frame rate, the control unit control lighting and extinction of the light-emitting unit in each frame such that a greater number of lighting periods than in a case where the frame rate is a second frame rate are included in one frame, wherein the second frame rate is higher than the first frame rate.

36. The image display apparatus according to claim 35, wherein the second frame rate is 60 Hz.

37. The image display apparatus according to claim 28, wherein the second frequency is 60 Hz.

38. The image display apparatus according to claim 28, wherein the number of lighting periods in a case where the drive frequency is 48 Hz is equal to the number of lighting periods in a case where the drive frequency is 50 Hz.

39. The image display apparatus according to claim 28, wherein in a case where a brightness of an image to be displayed on the display panel is bright, the control unit control lighting and extinction of the light-emitting unit in each frame such that a greater number of lighting periods than in a case where the brightness of the image is dark are included in one frame.

40. The image display apparatus according to claim 39, wherein the light-emitting unit is capable of varying a brightness thereof, and the control unit control lighting and extinction of the light-emitting unit in each frame by using the brightness of the light-emitting unit as the brightness of the image.

41. The image display apparatus according to claim 28, wherein the control unit control lighting and extinction of the light-emitting unit in each frame such that:

a plurality of extinction periods during which the light-emitting unit is extinguished are included in one frame; and a last extinction period in the frame becomes longer than the other extinction period in the frame.

42. An image display apparatus comprising:

a display panel configured to display a moving image;

a light-emitting unit configured to emit light to the display panel; and a control unit configured to control lighting and extinction of the light-emitting unit for each frame of the moving image to be displayed on the display panel, wherein the control unit controls, for reducing blur of the moving image to be displayed on the display panel, lighting and extinction of the light-emitting unit in each frame such that at least two lighting period different in length from each other are included in each frame, in a case where a frame rate of an input image data is a first frame rate, the control unit controls lighting and extinction of the light-emitting unit in each frame such that a greater number of lighting periods than in a case where the frame rate is a second frame rate are included in one frame, wherein the second frame rate is higher than the first frame rate, and in a case where three or more lighting periods are set within one frame, the control unit control lighting and extinction of the light-emitting unit in the frame such that a lighting period which is closer to a time corresponding to a center of the frame becomes longer relative to the other lighting period in the frame.

43. The image display apparatus according to claim 42, wherein the second frame rate is 60 Hz.

44. The image display apparatus according to claim 42, wherein in a case where three or more lighting periods are included in one frame, the control unit control lighting and extinction of the light-emitting unit in the frame such that intervals between the lighting periods within the frame are different in length from one another.

45. The image display apparatus according to claim 44, wherein in a case where three or more lighting periods are included in one frame, the control unit control lighting and extinction of the light-emitting unit in the frame such that the intervals between the lighting periods within the frame become shorter gradually.

46. The image display apparatus according to claim 44, wherein in a case where three or more lighting periods are included in one frame, the control unit control lighting and extinction of the light-emitting unit in the frame such that the intervals between the lighting periods within the frame become longer gradually.

47. The image display apparatus according to claim 42, wherein in a case where a brightness of an image to be displayed on the display panel is bright, the control unit control lighting and extinction of the light-emitting unit in each frame such that a greater number of lighting periods than in a case where the brightness of the image is dark are included in one frame.

48. The image display apparatus according to claim 47, wherein the light-emitting unit is capable of varying a brightness thereof, and the control unit control lighting and extinction of the light-emitting unit in each frame by using the brightness of the light-emitting unit as the brightness of the image.

49. The image display apparatus according to claim 42, wherein the control unit control lighting and extinction of the light-emitting unit in each frame such that:

in a case where an amount of motion of image between frames is large, an interval between the lighting periods within one frame becomes shorter than a case where the amount of motion of image between frames is small; and in a case where an amount of motion of image between frames is small, extinction periods during which the light-emitting unit is extinguished become more uniform in length than a case where the amount of motion of image between frames is large.

50. The image display apparatus according to claim 42, wherein the control unit control lighting and extinction of the light-emitting unit in each frame such that, in a case where an amount of motion of image between frames is large, a difference in length among the lighting periods within one frame becomes larger than a case where the amount of motion of image between frames is small.

51. The image display apparatus according to claim 42, wherein the light-emitting unit has a configuration capable of controlling lighting and extinction for each of a plurality of divided regions constituting an area of a screen, and the control unit control the lighting periods for each divided region.

52. The image display apparatus according to claim 42, wherein the control unit control lighting and extinction of the light-emitting unit in each frame such that:

a plurality of extinction periods during which the light-emitting unit is extinguished are included in one frame; and a last extinction period in the frame becomes longer than the other extinction period in the frame.

53. An image display apparatus comprising:

a display panel configured to display a moving image;

a light-emitting unit configured to emit light to the display panel; and a control unit configured to control lighting and extinction of the light-emitting unit for each frame of the moving image to be displayed on the display panel, wherein the control unit controls, for reducing blur of the moving image to be displayed on the display panel, lighting and extinction of the light-emitting unit in each frame such that at least two lighting period different in length from each other are included in each frame.

* * * * *